US011757238B2

(12) United States Patent
Little

(10) Patent No.: US 11,757,238 B2
(45) Date of Patent: Sep. 12, 2023

(54) ELECTRICAL CONNECTOR ASSEMBLY INCLUDING A REAR INSULATIVE BODY HAVING UPPER AND LOWER WIRE RECEIVING SLOTS AND A PAIR OF METALLIC SHIELDS HAVING ENGAGEMENT TABS

(71) Applicants: FOXCONN (KUNSHAN) COMPUTER CONNECTOR CO., LTD., San Jose, CA (US); Foxconn Interconnect Technology Limited, San Jose, CA (US)

(72) Inventor: Terrance F Little, Fullerton, CA (US)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 17/456,884

(22) Filed: Nov. 29, 2021

(65) Prior Publication Data

US 2022/0173555 A1 Jun. 2, 2022

Related U.S. Application Data

(60) Provisional application No. 63/118,829, filed on Nov. 27, 2020.

(51) Int. Cl.

| | |
|---|---|
| ***H01R 24/76*** | (2011.01) |
| ***H01R 12/58*** | (2011.01) |
| ***H01R 13/6597*** | (2011.01) |
| ***H01R 13/504*** | (2006.01) |
| ***H01R 13/6593*** | (2011.01) |
| ***H01R 107/00*** | (2006.01) |

(52) U.S. Cl.

CPC ..... *H01R 24/76* (2013.01); *H01R 12/58* (2013.01); *H01R 13/504* (2013.01); *H01R 13/6593* (2013.01); *H01R 13/6597* (2013.01); *H01R 2107/00* (2013.01)

(58) Field of Classification Search

None

See application file for complete search history.

(56) References Cited

U.S. PATENT DOCUMENTS

| | | | | |
|---|---|---|---|---|
| 7,494,383 | B2 | 2/2009 | Amphenol | |
| 9,011,177 | B2 | 4/2015 | Molex | |
| 10,056,706 | B2 | 8/2018 | Molex | |
| 10,651,606 | B2 | 5/2020 | Foxconn | |
| 10,680,389 | B2 * | 6/2020 | Little | H01R 13/6587 |
| RE48,230 | E | 9/2020 | Molex | |
| 10,923,843 | B1 * | 2/2021 | Henry | H01R 12/714 |

(Continued)

*Primary Examiner* — Oscar C Jimenez

(74) *Attorney, Agent, or Firm* — Ming Chieh Chang

(57) ABSTRACT

An electrical connector assembly includes a contact module having an upper part and a lower part stacked with each other. The upper part includes a front/outer upper unit and a rear/inner upper unit and the lower part includes a front/outer lower unit and a rear/inner lower unit. Each unit includes an insulative body and a plurality of contacts integrally formed with the insulative body via an insert-molding process. The insulative body includes a middle sector and a pair of side sectors. The contacts include side-band contacts retained in the middle sector and differential-pair contacts retained in the side sectors.

20 Claims, 53 Drawing Sheets

(56) References Cited

U.S. PATENT DOCUMENTS

| | | | | |
|---|---|---|---|---|
| 11,025,013 | B2 | 6/2021 | Foxconn | |
| 2016/0218455 | A1 | 7/2016 | Sayre et al. | |
| 2019/0181593 | A1* | 6/2019 | Little | H01R 13/6593 |
| 2020/0274267 | A1 | 8/2020 | Zerebilov et al. | |
| 2020/0358227 | A1 | 11/2020 | Henry et al. | |
| 2021/0257785 | A1* | 8/2021 | Shah | H01R 12/72 |
| 2021/0351547 | A1* | 11/2021 | Little | H01R 13/6581 |
| 2022/0320786 | A1* | 10/2022 | Little | H01R 13/405 |

* cited by examiner

ELECTRICAL CONNECTOR ASSEMBLY INCLUDING A REAR INSULATIVE BODY HAVING UPPER AND LOWER WIRE RECEIVING SLOTS AND A PAIR OF METALLIC SHIELDS HAVING ENGAGEMENT TABS

CROSS REFERENCE TO RELATED APPLICATION

This application claims priority to U.S. Application No. 63/118,829, filed Nov. 27, 2020, the content of which is incorporated herein by reference in its entirety.

BACKGROUND OF THE INVENTION

1. Field of the Invention

The invention relates to the electrical connector assembly, and particularly to the electrical connector assembly including the four-layer contact module each having the side-band contacts mounted to the printed circuit board and the differential-pair contacts mechanically and electrically connected to the wires.

2. Description of Related Art

On one hand, U.S. provisional applications 63/053,611 and 63/090,225 with the same inventor of the instant application disclose the electrical connector assembly including the four-layer contact module for mounting to the printed circuit board. On the other hand, U.S. provisional application 63/022,492 also with the same inventor of the instant application discloses the electrical connector assembly having a pair of differential-pair contact zones commonly sandwich a side-band contact zone therebetween in the transverse direction wherein the side-band contacts are directly mounted to the printed circuit board while the differential-pair contacts are mechanically and electrically connected to the corresponding wires.

SUMMARY OF THE INVENTION

Therefore, the instant invention is to provide a hybrid type electrical connector assembly essentially composed of the four-layer contact module with the different contact zones in the transverse direction for respectively connecting to the printed circuit board and the wires. The electrical connector includes an insulative housing for mounting to the printed circuit board, and a contact module received within the insulative housing. The contact module includes an upper part and a lower part stacked with each other in the vertical direction. The upper part includes a front/outer upper unit and a rear/inner upper unit. The lower part includes a front/outer lower unit and a rear/inner lower unit. Each unit includes an insulative body and a plurality of contacts integrally formed with the insulative body via an insert-molding process. The insulative body includes a middle sector and a pair of side sectors. The contacts include the side-band contacts retained in the middle sector, and the differential-pair contacts retained in the side sectors. The tail sections of the side-band contacts are further equipped with the spacer for correctly mounting to the printed circuit board. The side sector forms a plurality of grooves to receive the tail sections of the differential-pair contacts and the corresponding wires which are soldered to the tail sections of the differential-pair contacts. The insulative body further forms the coupling structures so as to be engaged with those of the neighboring unit. Each unit further includes a pair of grounding brackets each cooperating with a transverse bar of the corresponding grounding contacts to sandwich the corresponding wires therebetween in the vertical direction. A pair of metallic shields commonly enclose the contact module therein.

Other advantages and novel features of the invention will become more apparent from the following detailed description of the present embodiment when taken in conjunction with the accompanying drawings.

DETAILED DESCRIPTION OF THE PREFERRED EMBODIMENT

Reference will now be made in detail to the embodiments of the present disclosure.

Figure 1:
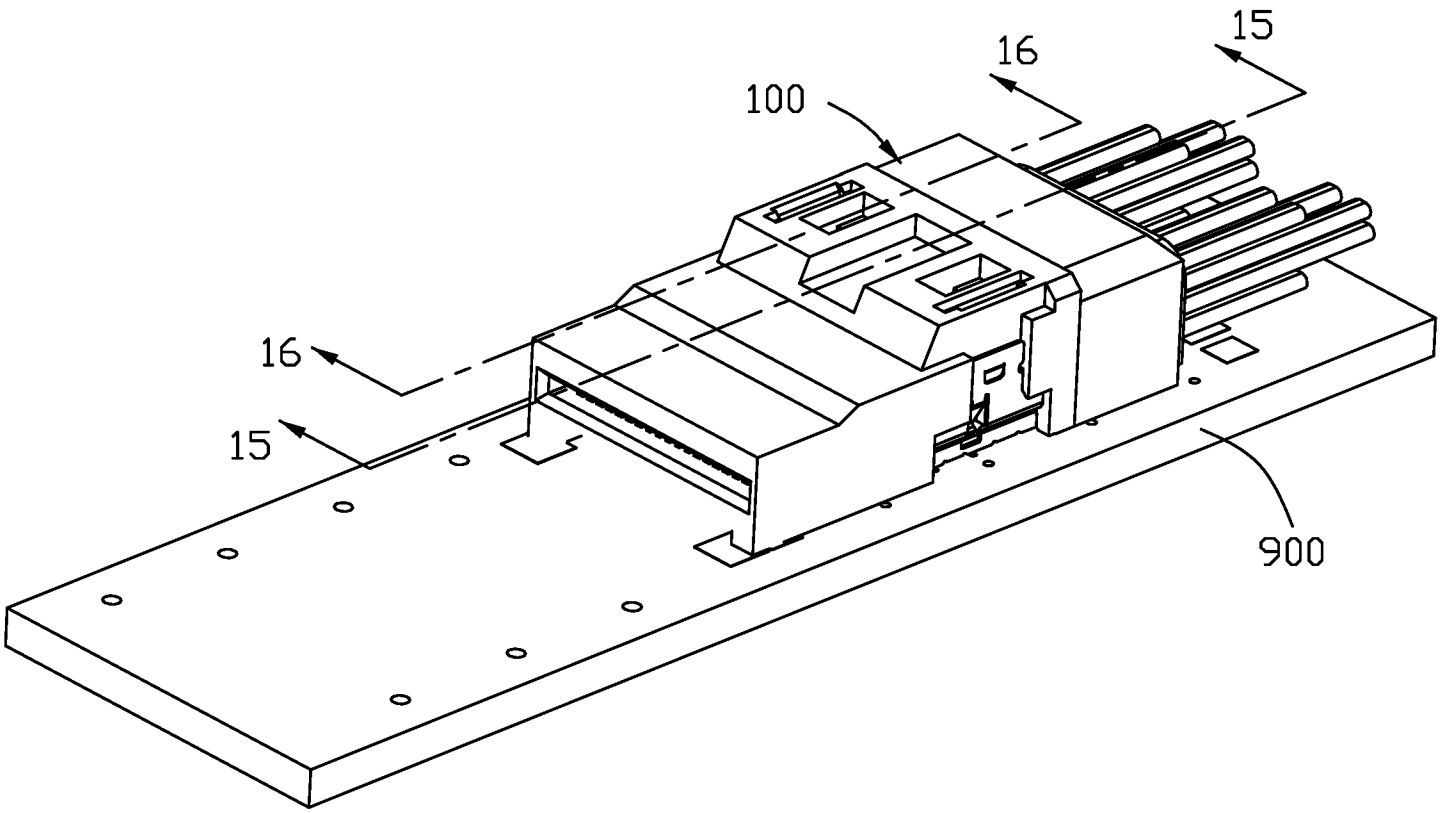
FIG. 1 is a perspective view of an electrical connector assembly mounted upon a printed circuit board.
Figure 2:
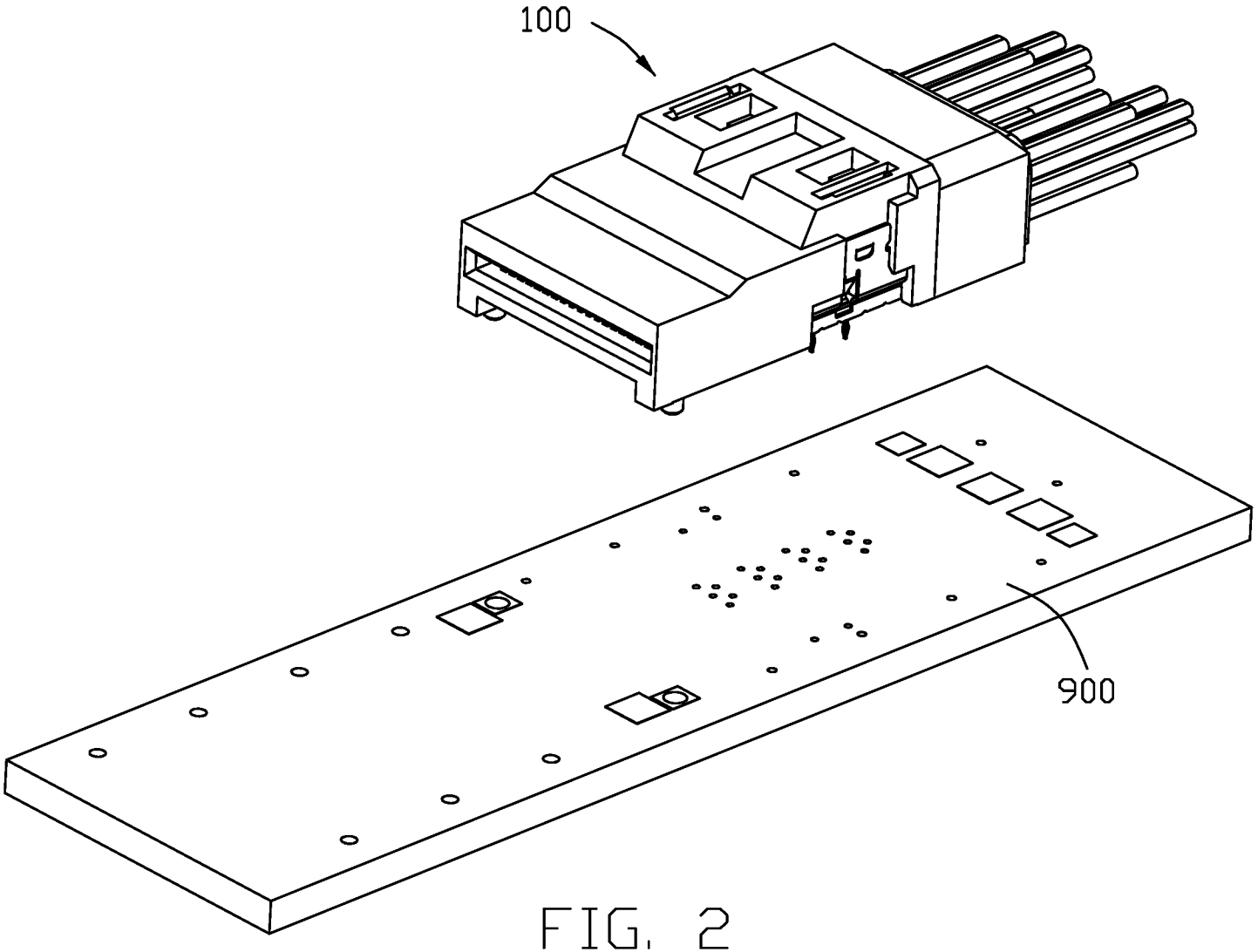
FIG. 2 is an exploded perspective view of the electrical connector assembly removed away from the printed circuit board of FIG. 1.
Figure 3A:
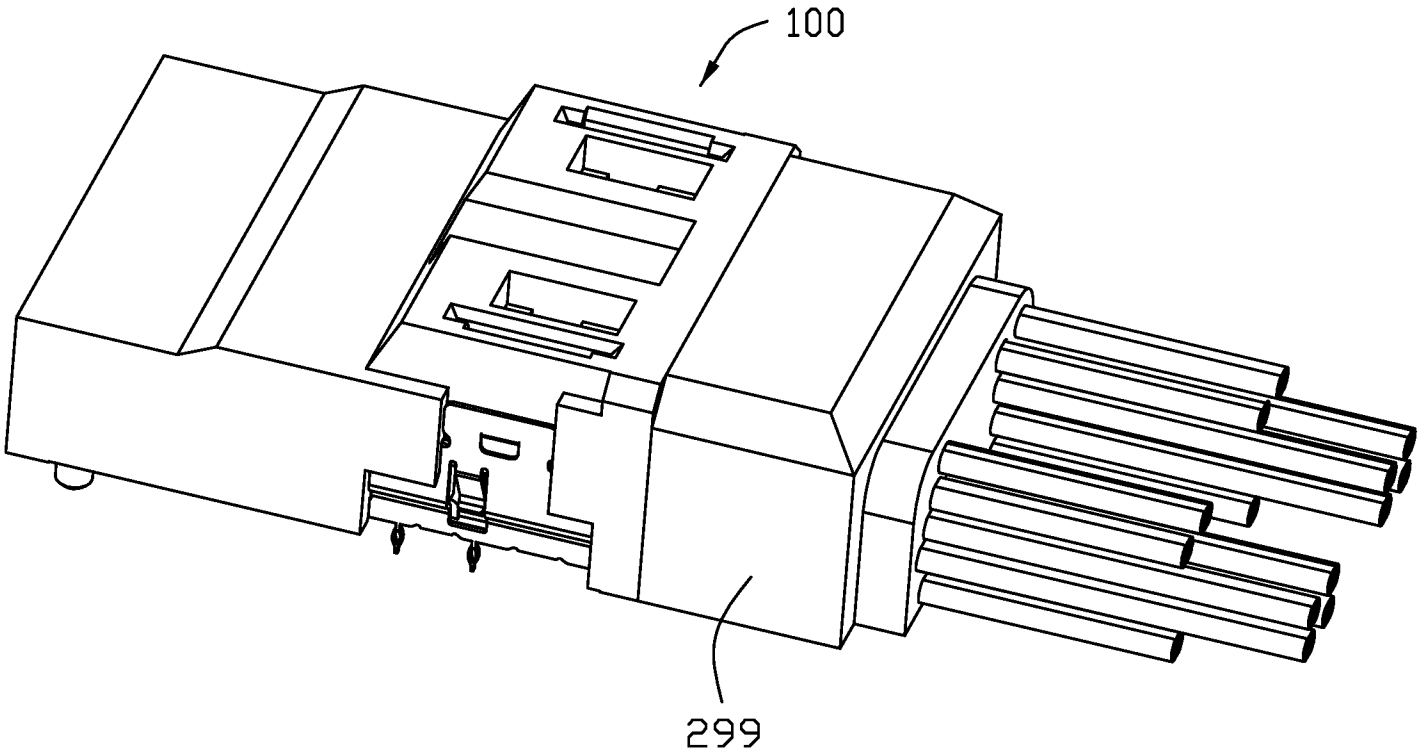
FIG. 3(A) is a perspective view of the electrical connector assembly of FIG. 1.
Figure 3B:
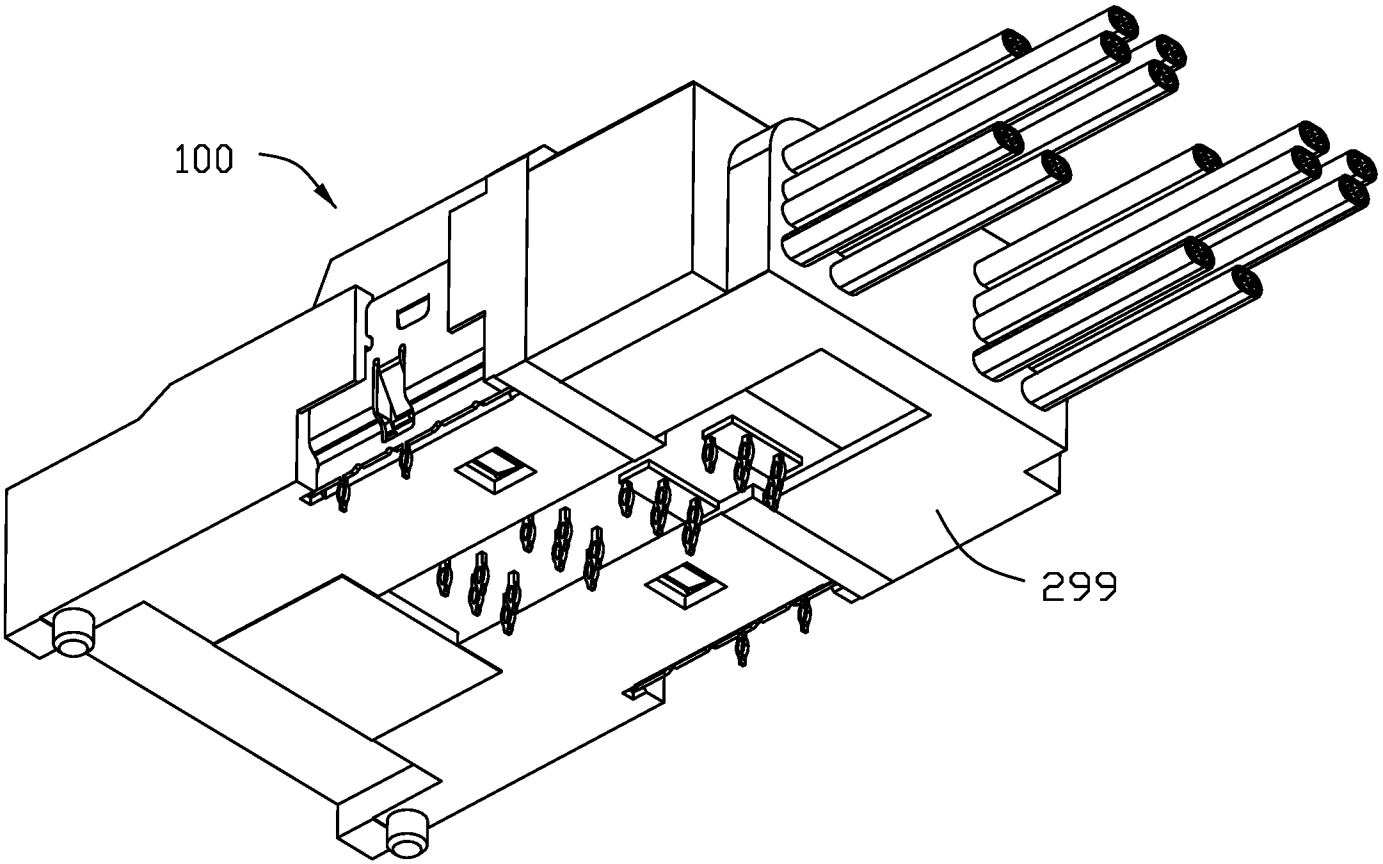
FIG. 3(B) is another perspective view of the electrical connector assembly of FIG. 3(A)
Figure 3C:
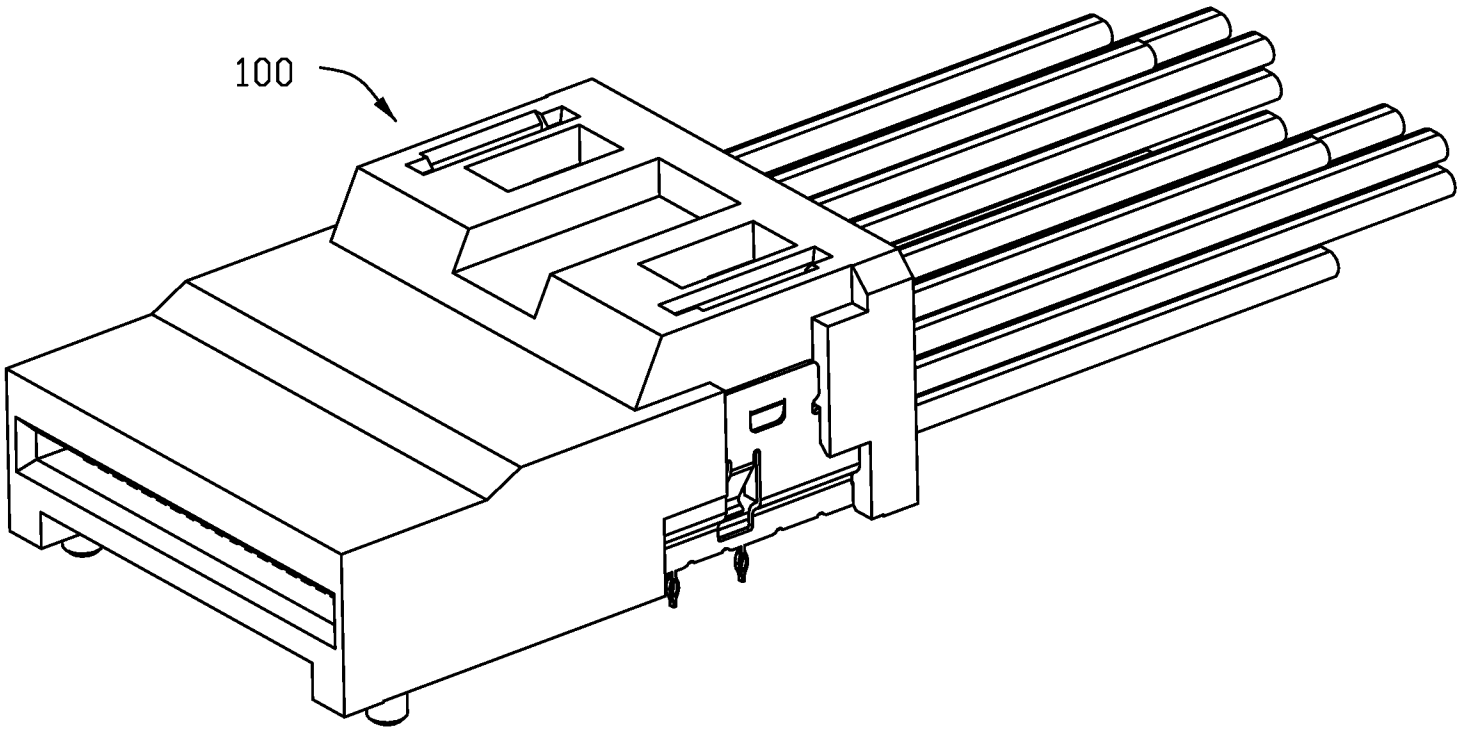
FIG. 3(C) is another perspective view of the electrical connector assembly of FIG. 3(A)
Figure 4A:
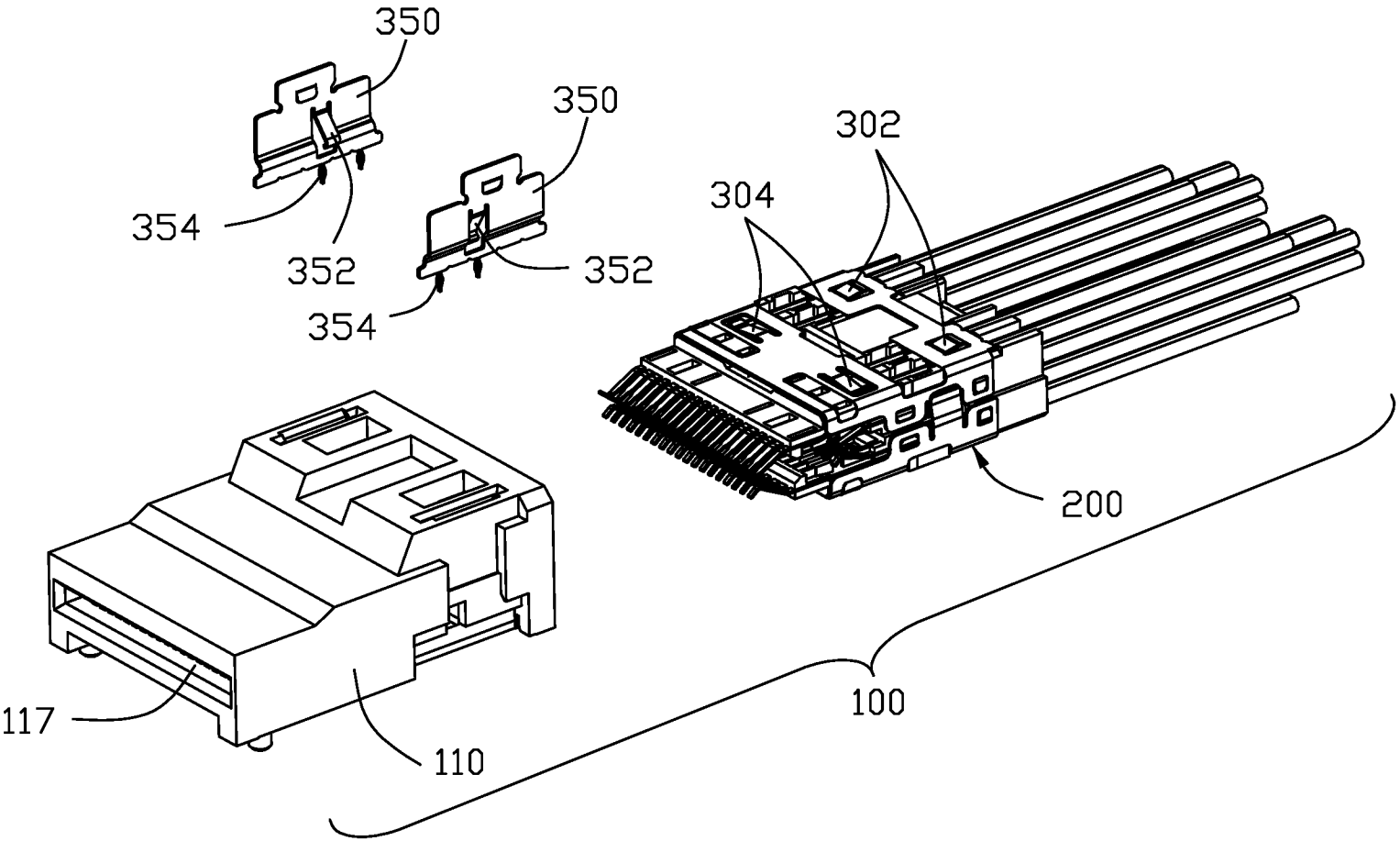
FIG. 4(A) is an exploded perspective view of the electrical connector assembly of FIG. 3(A)
Figure 4B:
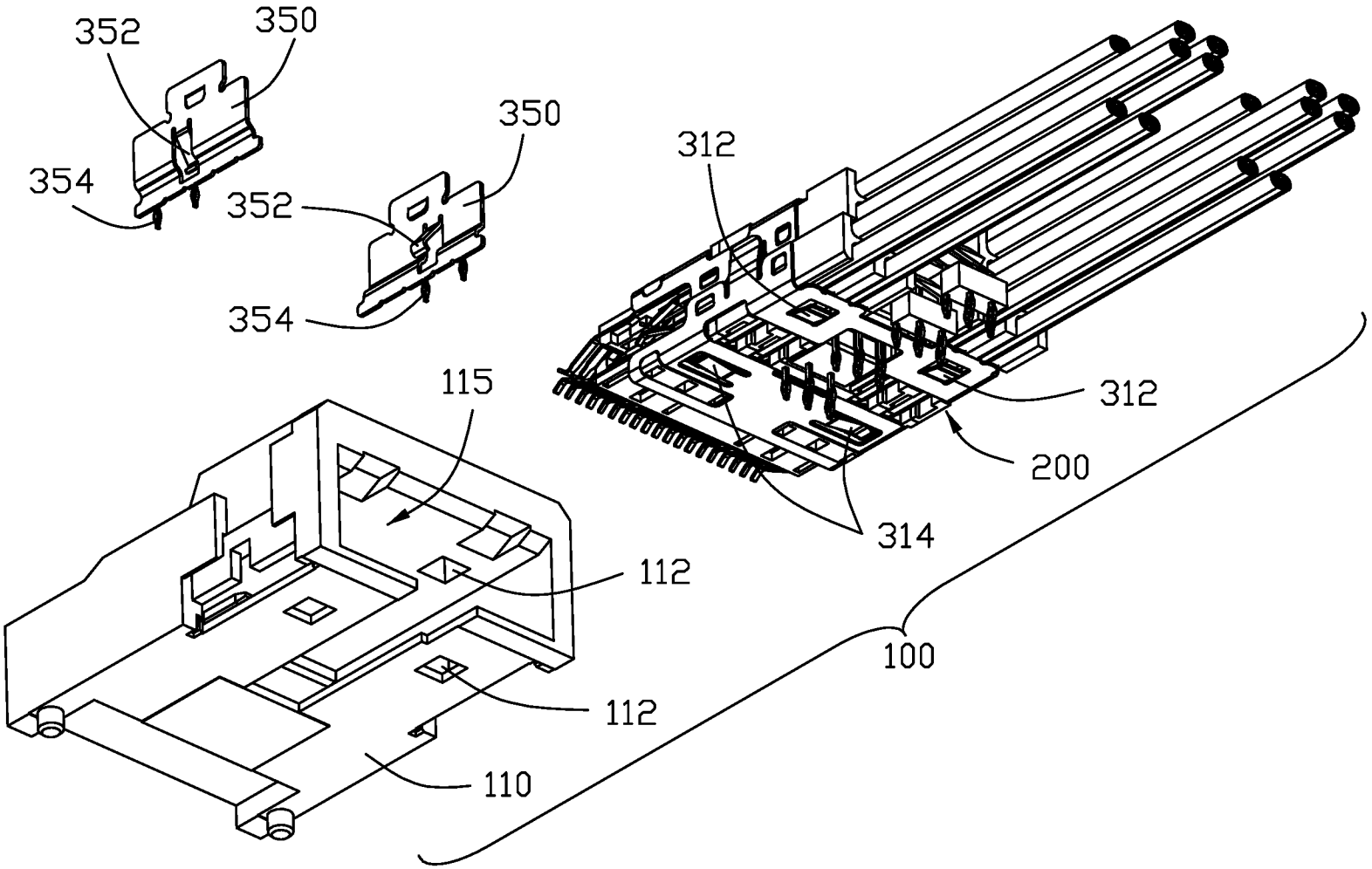
FIG. 4(B) is another exploded perspective view of the electrical connector assembly of FIG. 4(A)
Figure 5A:
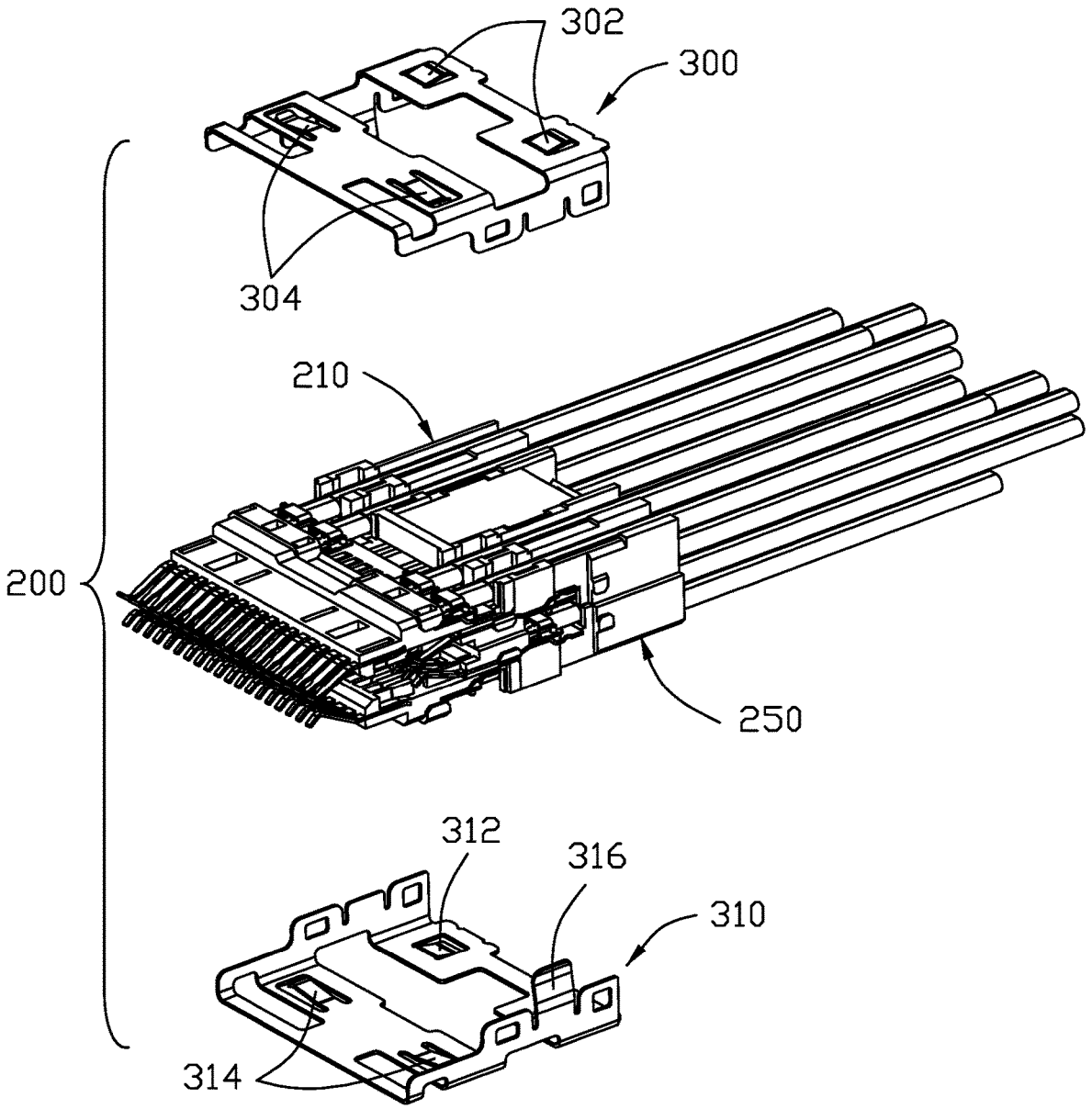
FIG. 5(A) is an exploded perspective view of the contact module of the electrical connector assembly of FIG. 4(A) wherein the metallic shields are removed away from the four-layer structure thereof.
Figure 5B:
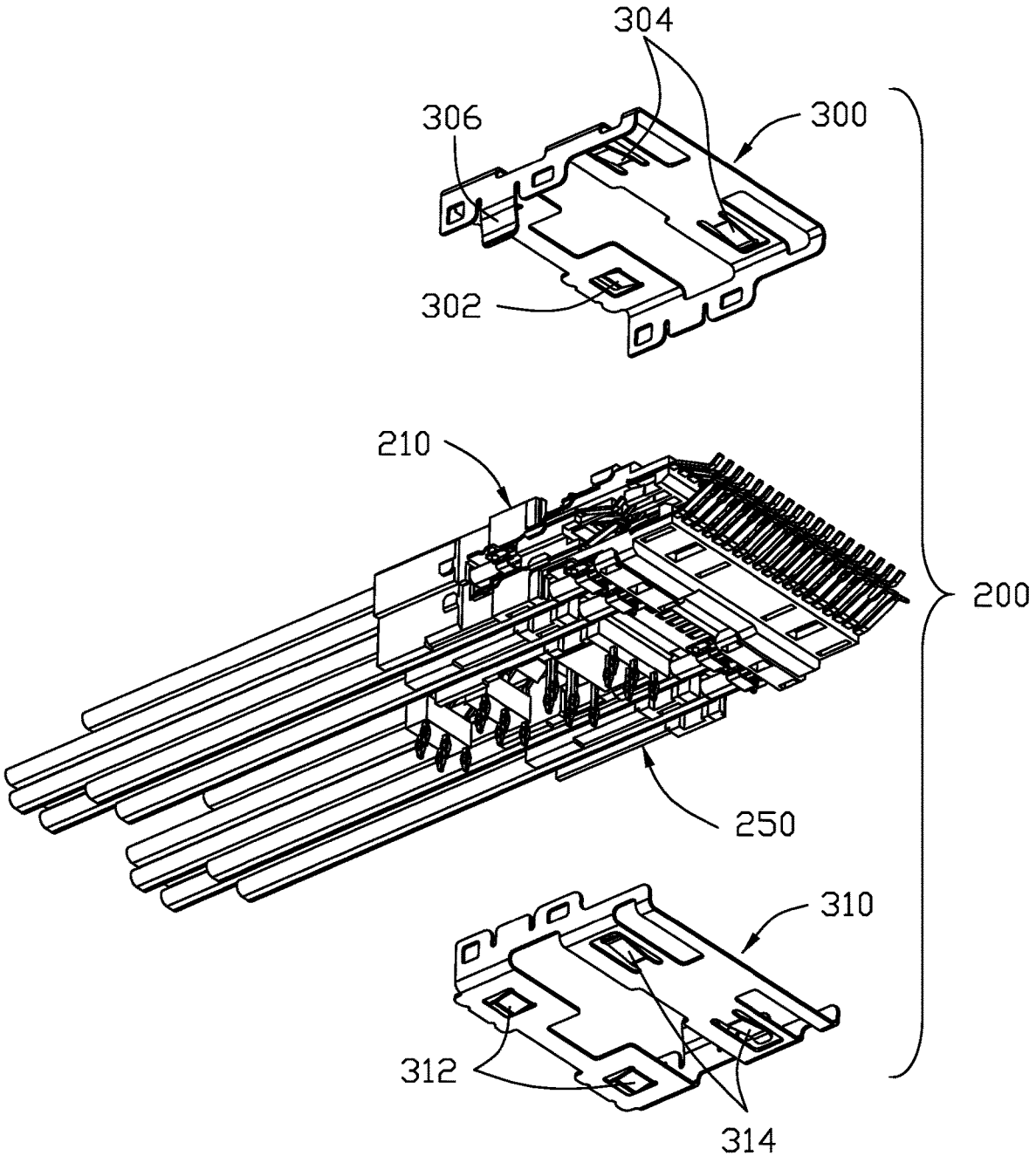
FIG. 5(B) is another exploded perspective view of the contact module of the electrical connector assembly of FIG. 5(A)
Figure 6A:
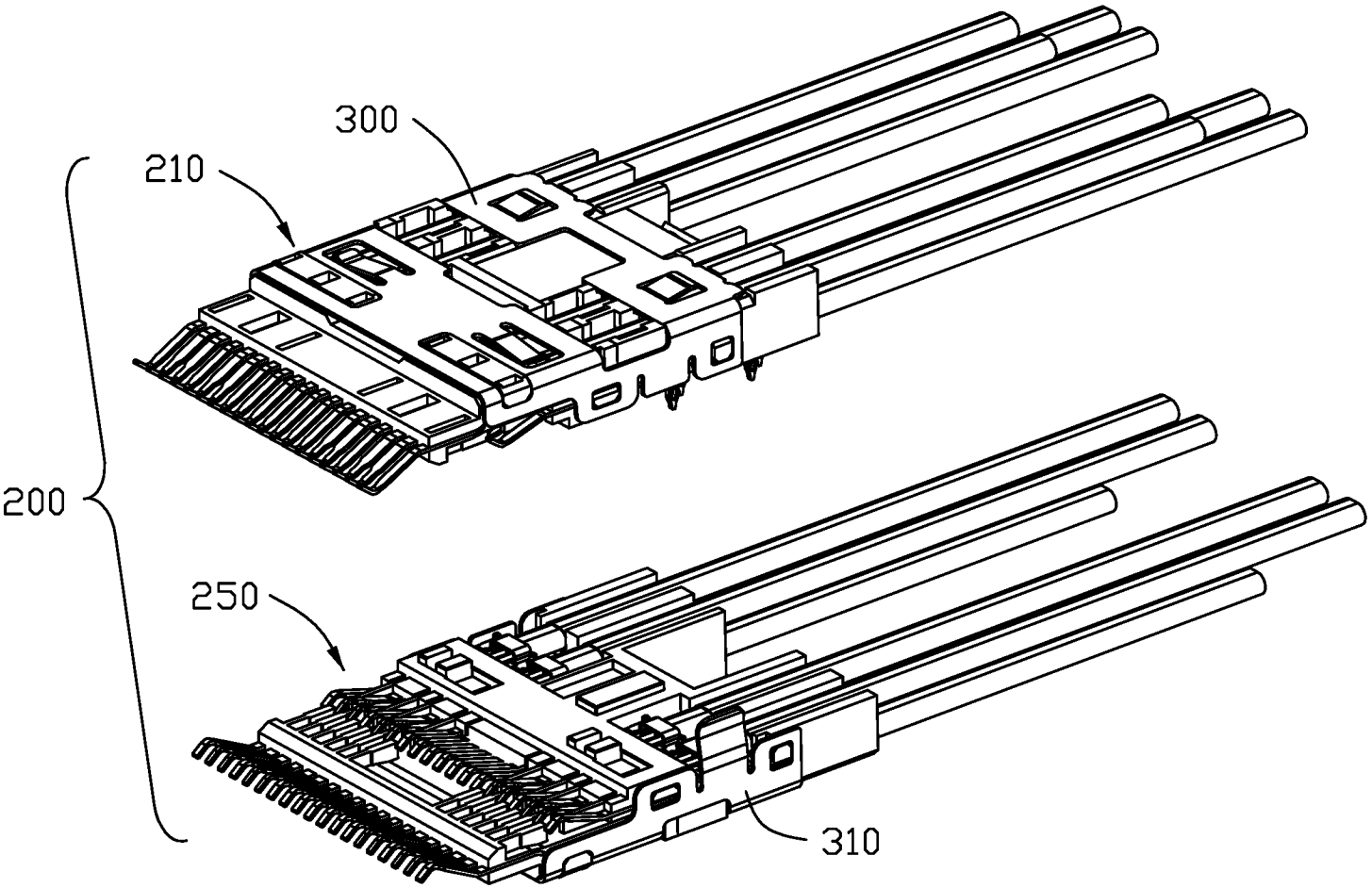
FIG. 6(A) is an exploded perspective view of the contact module of the electrical connector assembly of FIG. 4(A) wherein the upper part and the lower part are separated from each other.
Figure 6B:
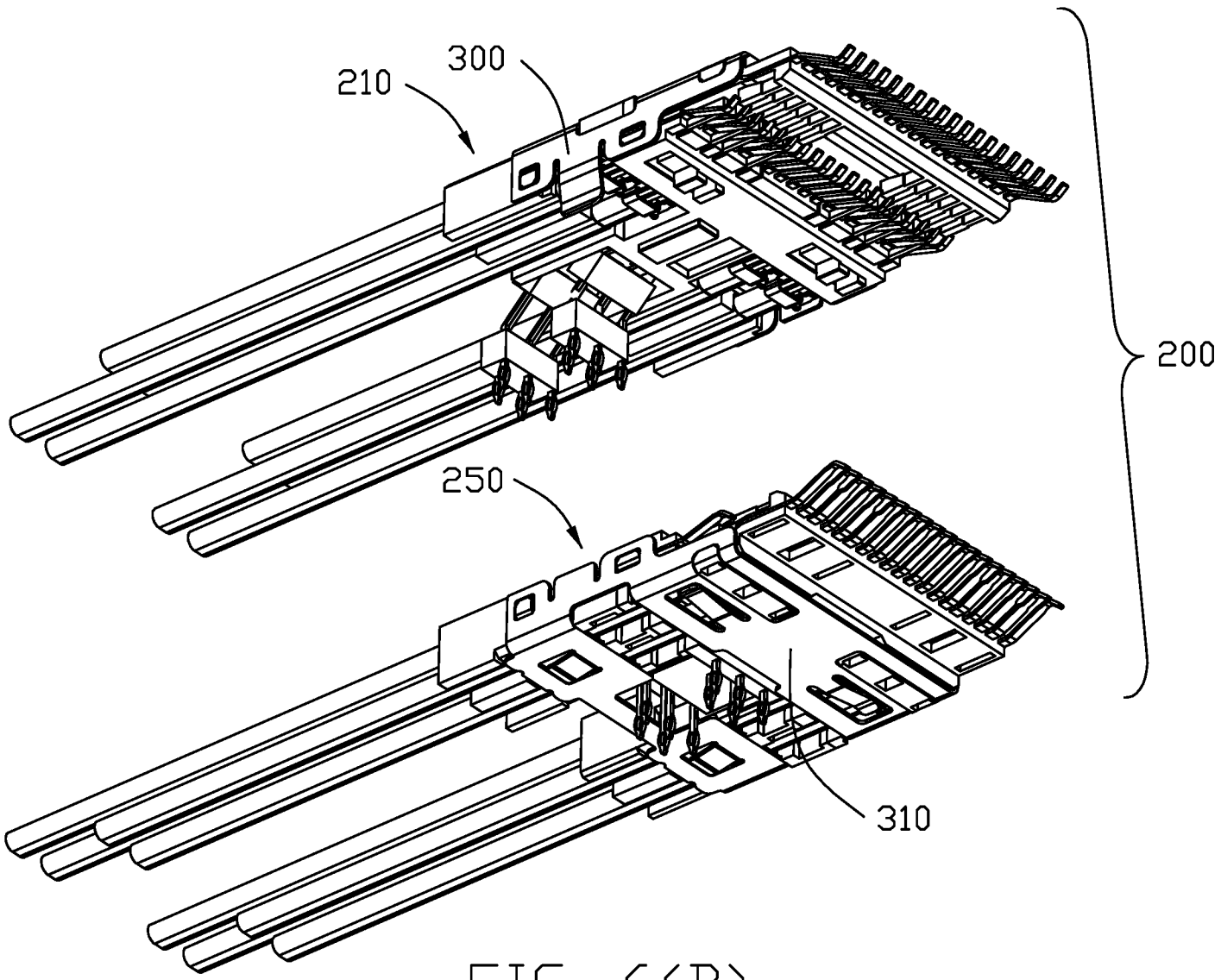
FIG. 6(B) is another exploded perspective view of the contact module of the electrical connector assembly of FIG. 6(A)
Figure 7:
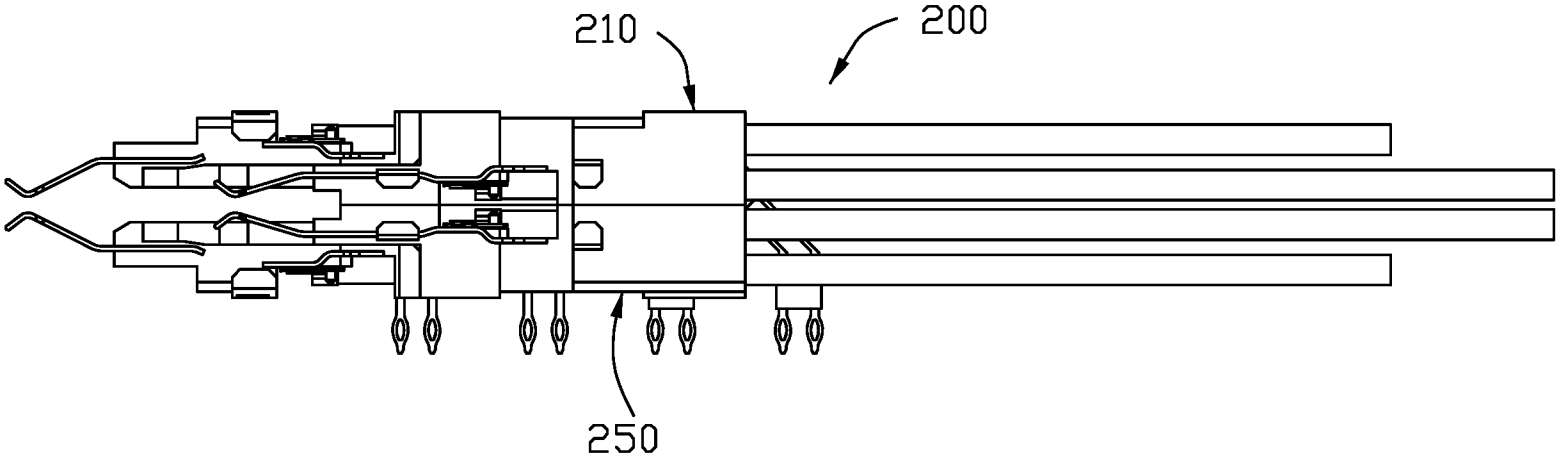
FIG. 7 is a rough side view of the contact module of the electrical connector assembly of FIG. 3(A)
Figure 8A:
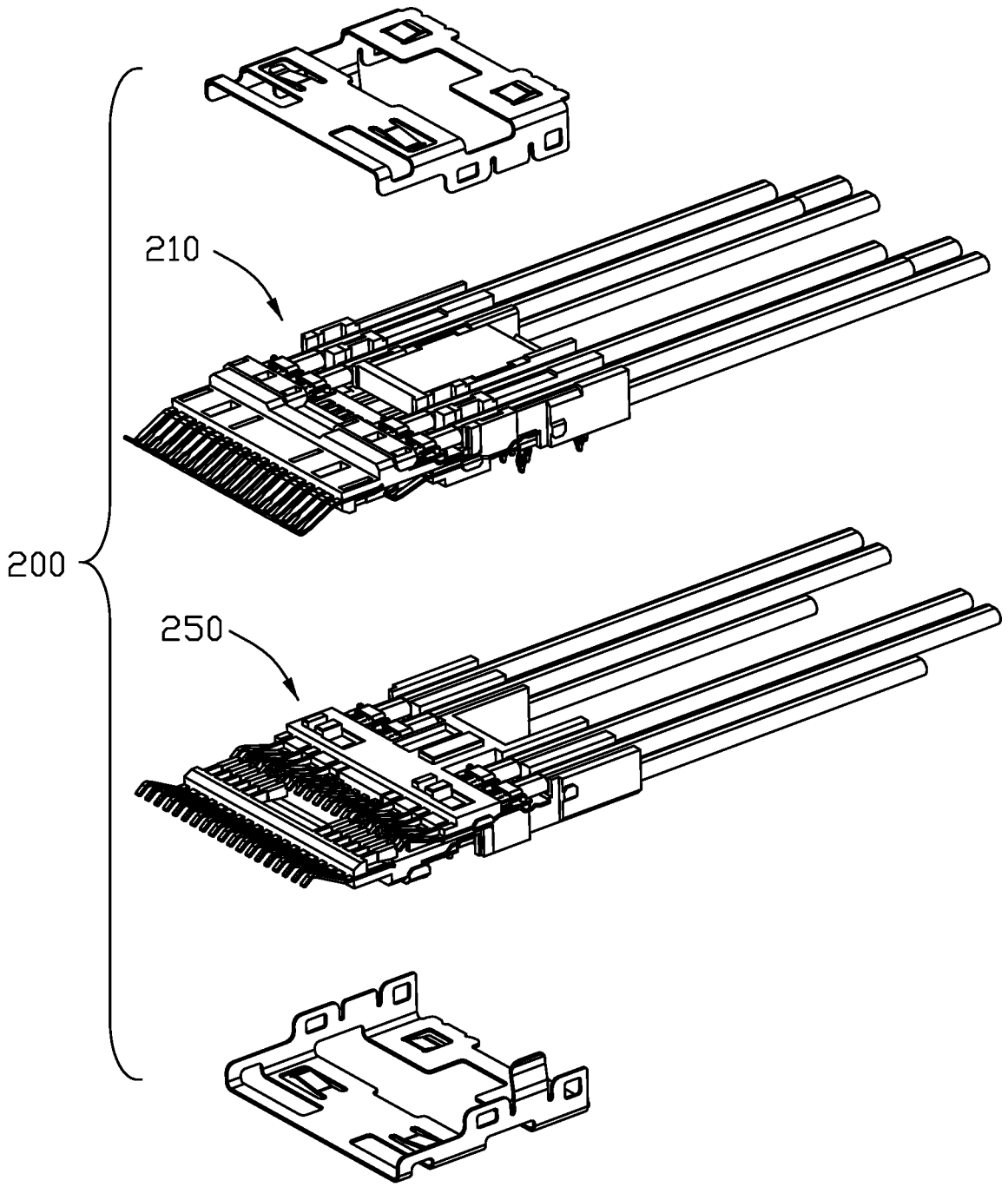
FIG. 8(A) is a further exploded perspective view of the contact module of the electrical connector assembly of FIG. 5(A)
Figure 8B:
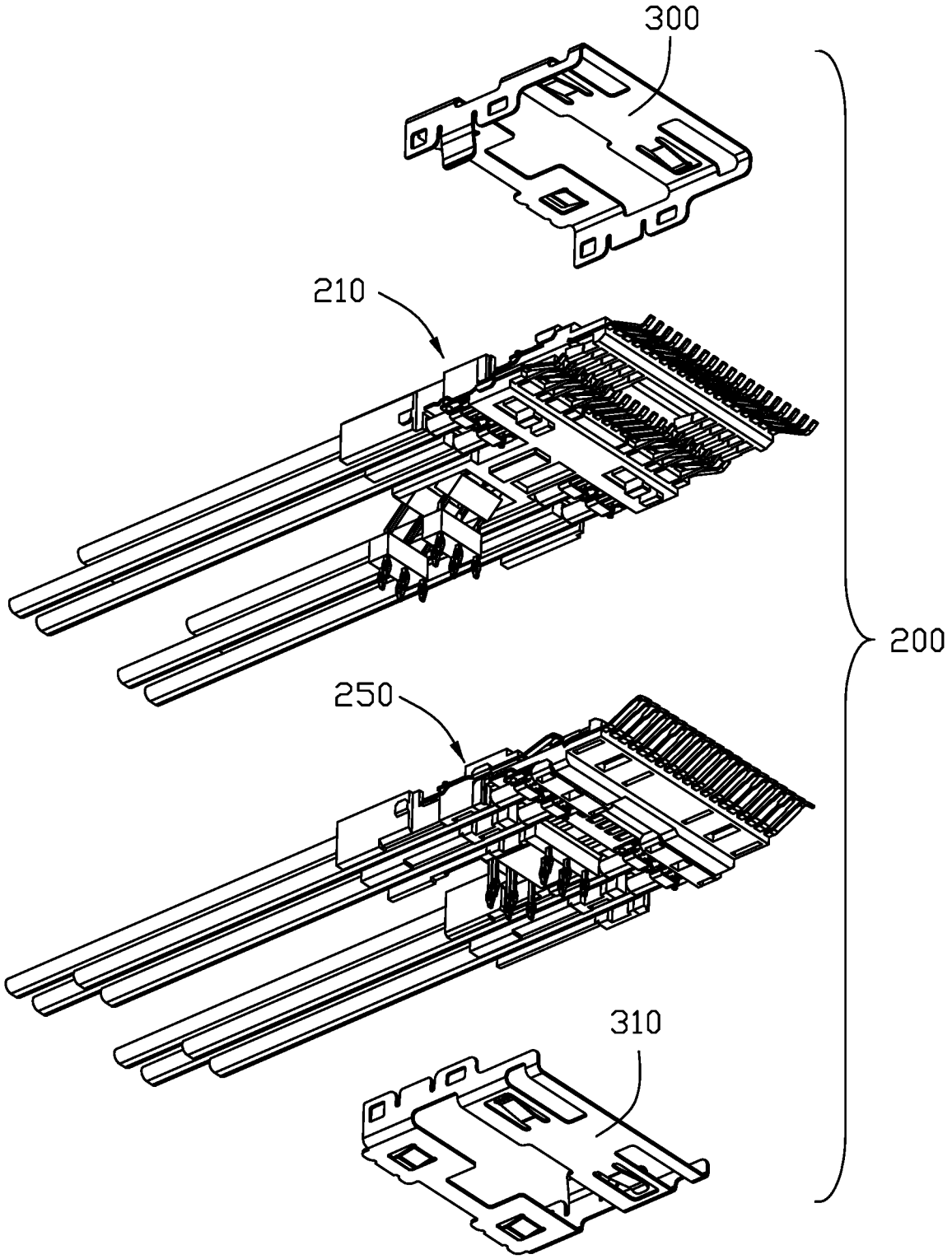
FIG. 8(B) is another exploded perspective view of the contact module of the electrical connector assembly of FIG. 8(A)
Figure 9A:
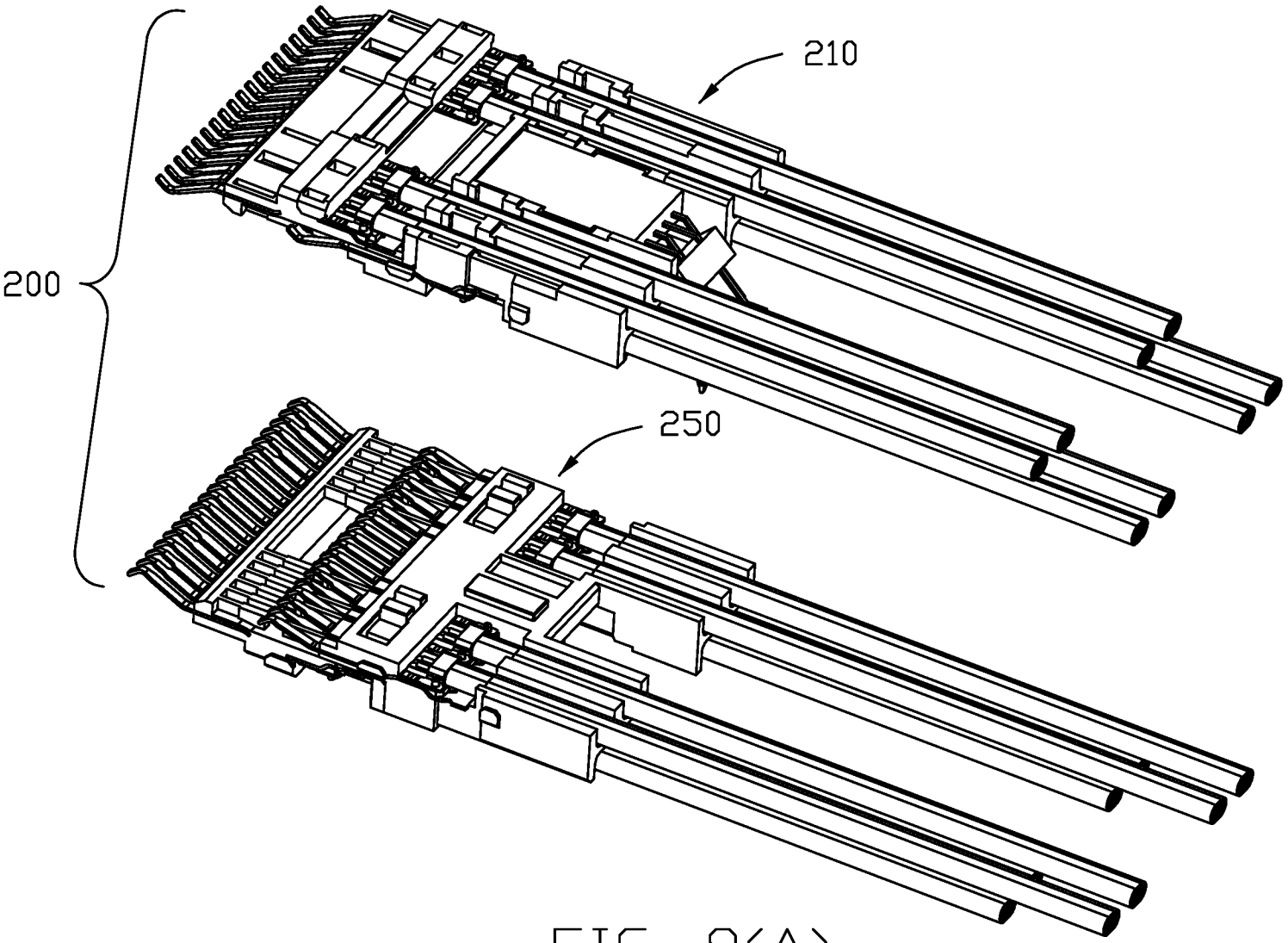
FIG. 9(A) is an exploded perspective view of the contact module of the electrical connector assembly of FIG. 6(A) without showing the metallic shields.
Figure 9B:
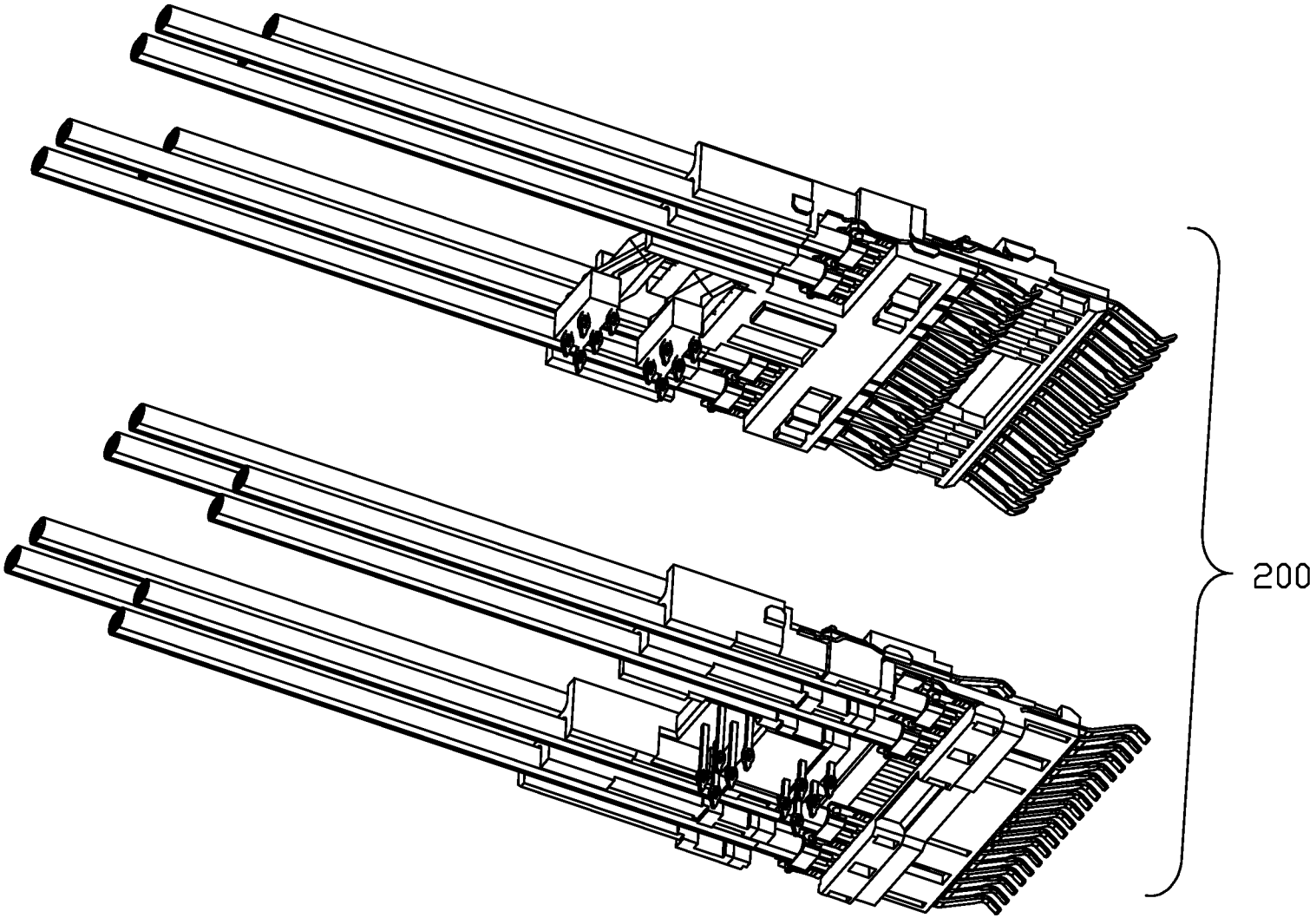
FIG. 9(B) is another exploded perspective view of the contact module of the electrical connector assembly of FIG. 9(A)
Figure 10A:
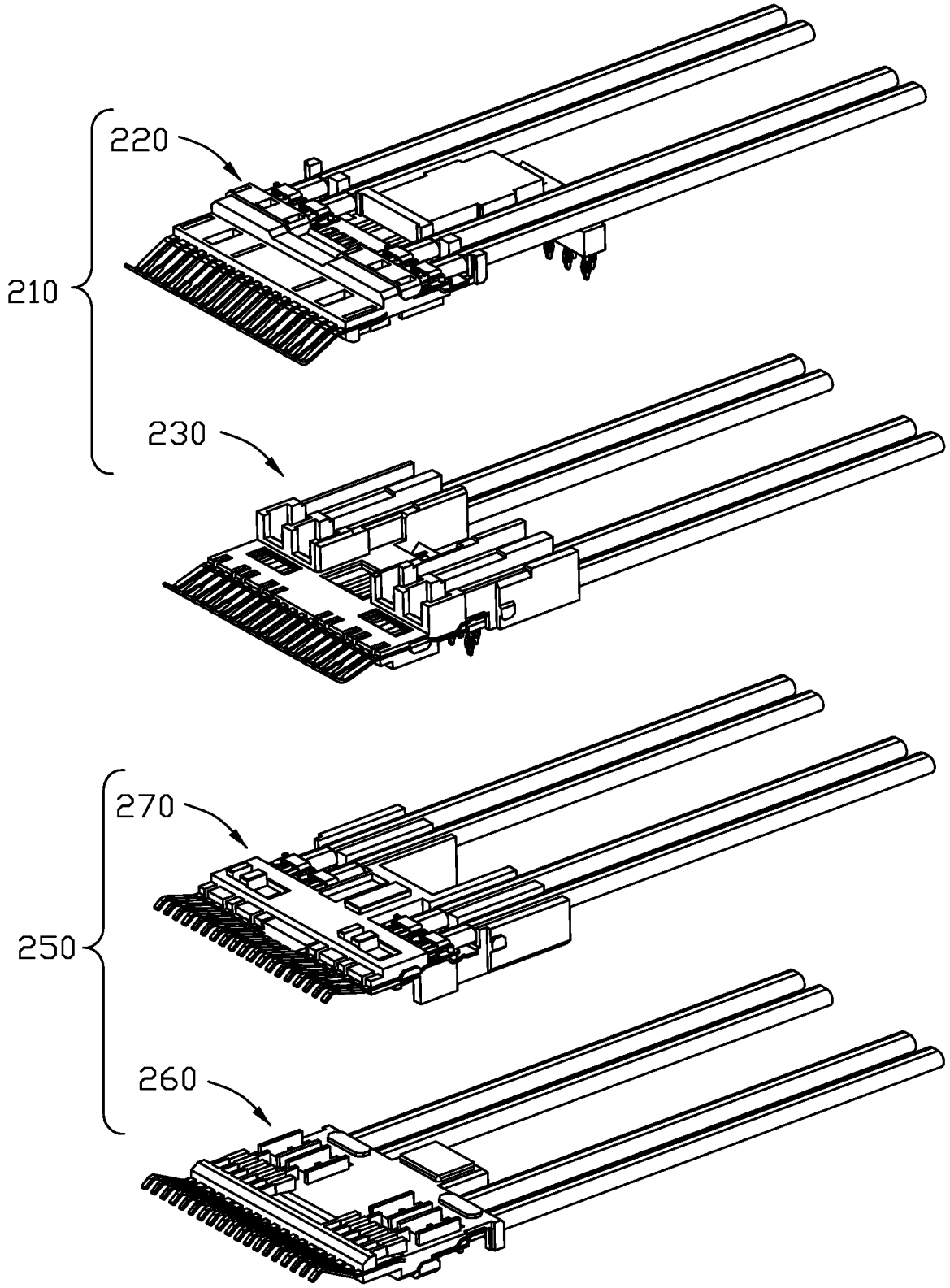
FIG. 10(A) is a further exploded perspective view of the contact module of the electrical connector assembly of FIG. 9(A)
Figure 10B:
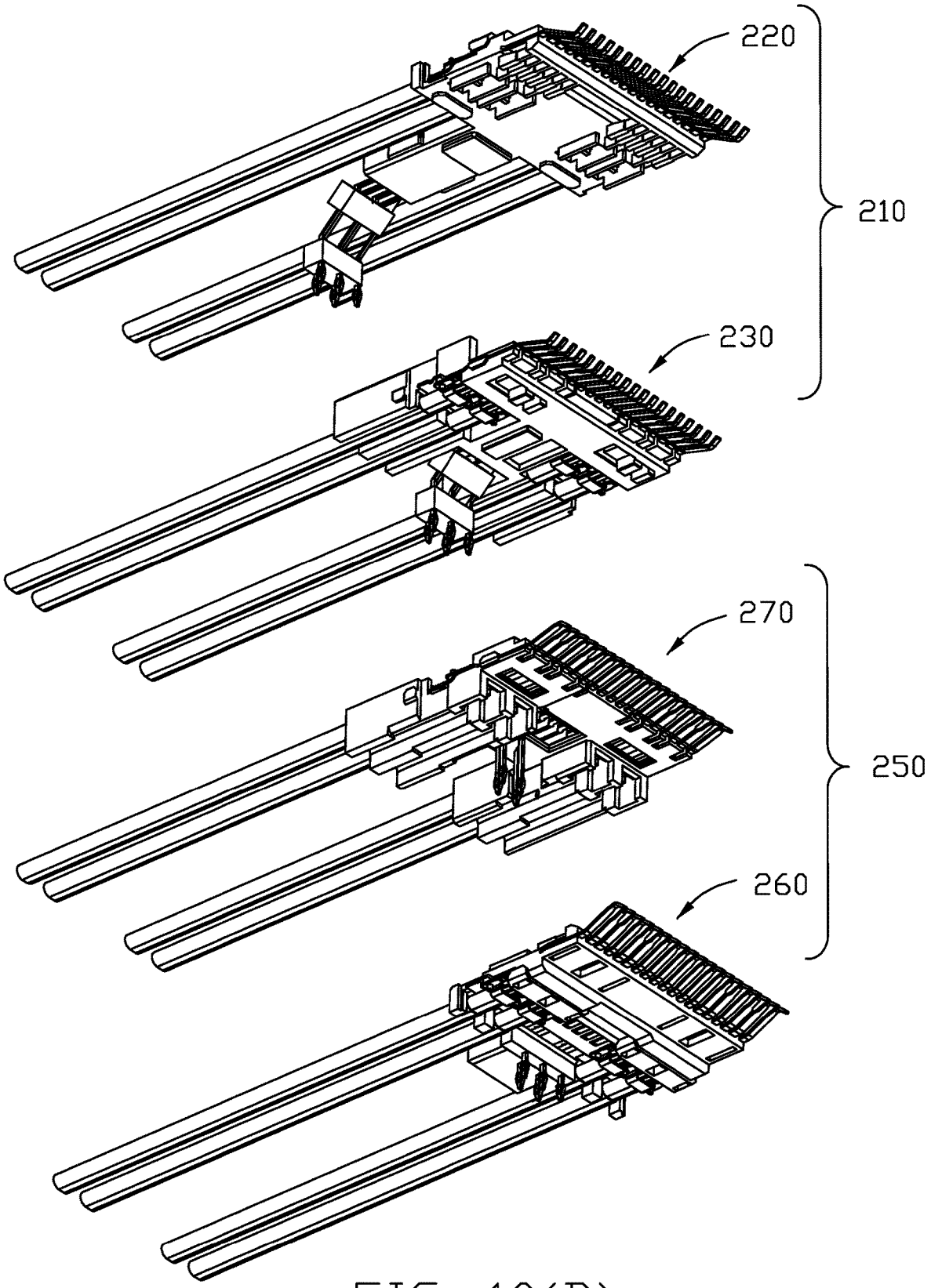
FIG. 10(B) is another exploded perspective view of the contact module of the electrical connector assembly of FIG. 10(A)
Figure 11A:
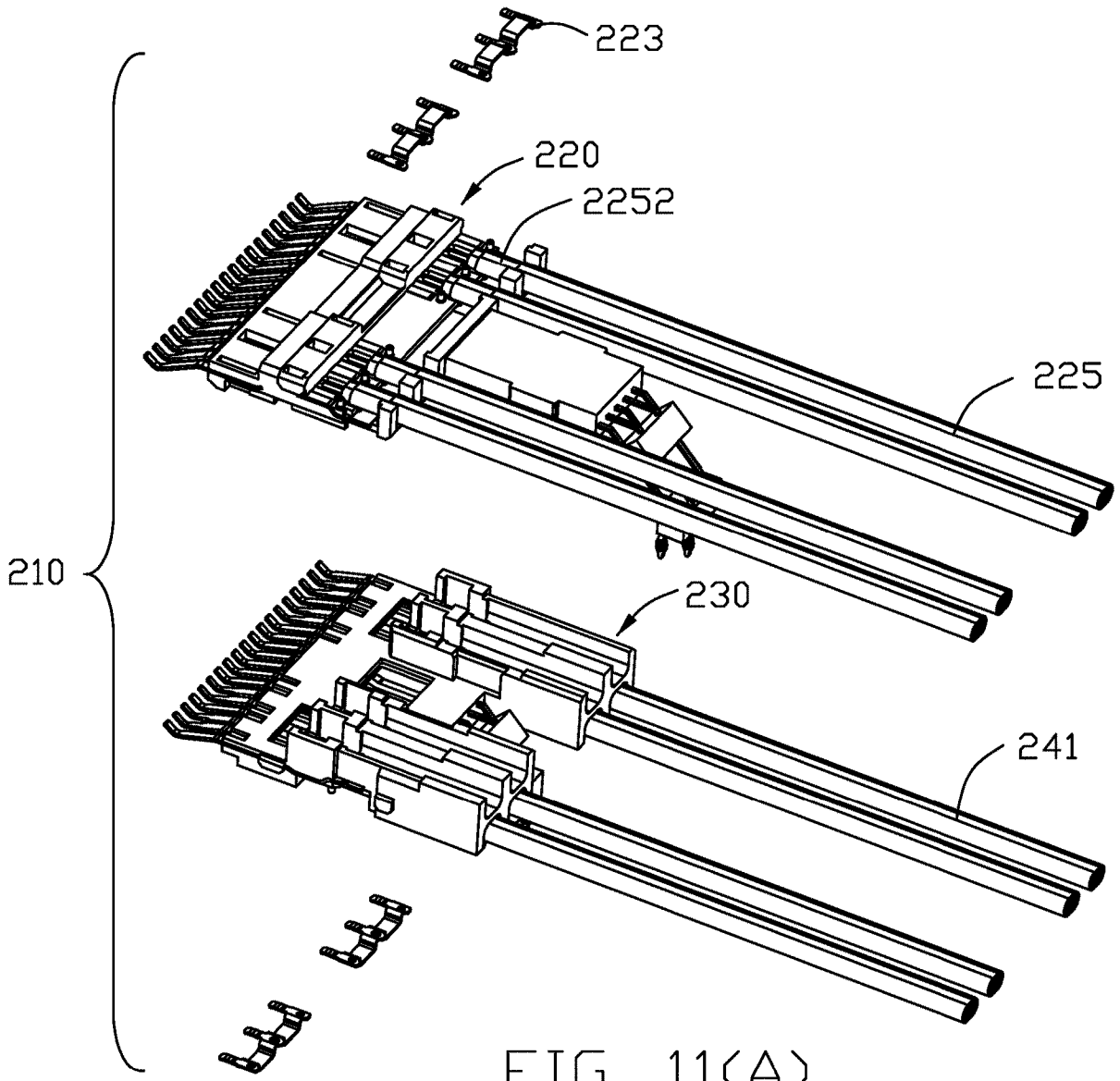
FIG. 11(A) is an exploded perspective view of the upper part of the contact module of the electrical connector assembly of FIG. 10(A)
Figure 11B:
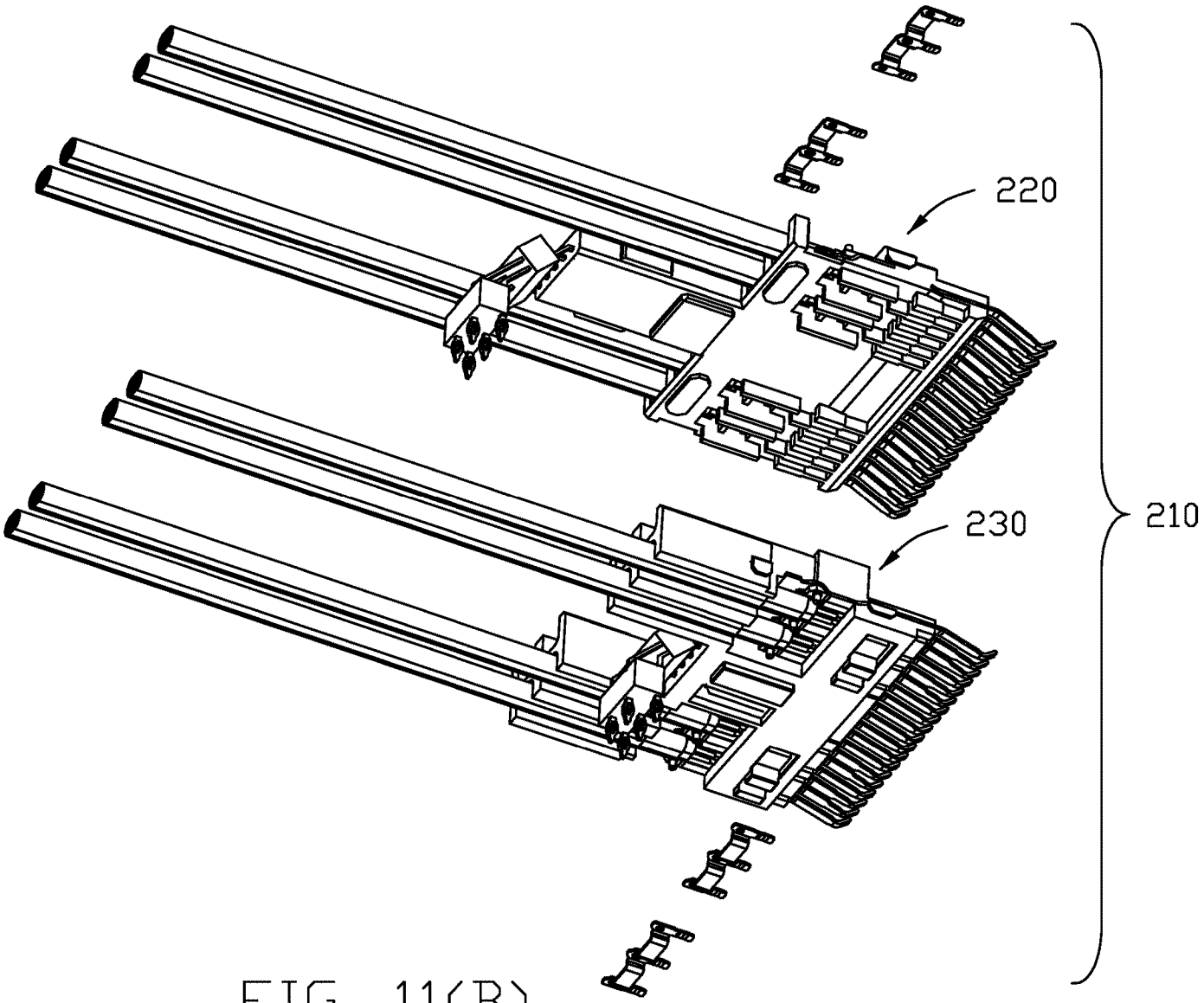
FIG. 11(B) is another exploded perspective view of the upper part of the contact module of the electrical connector assembly of FIG. 11(A)
Figure 12A:
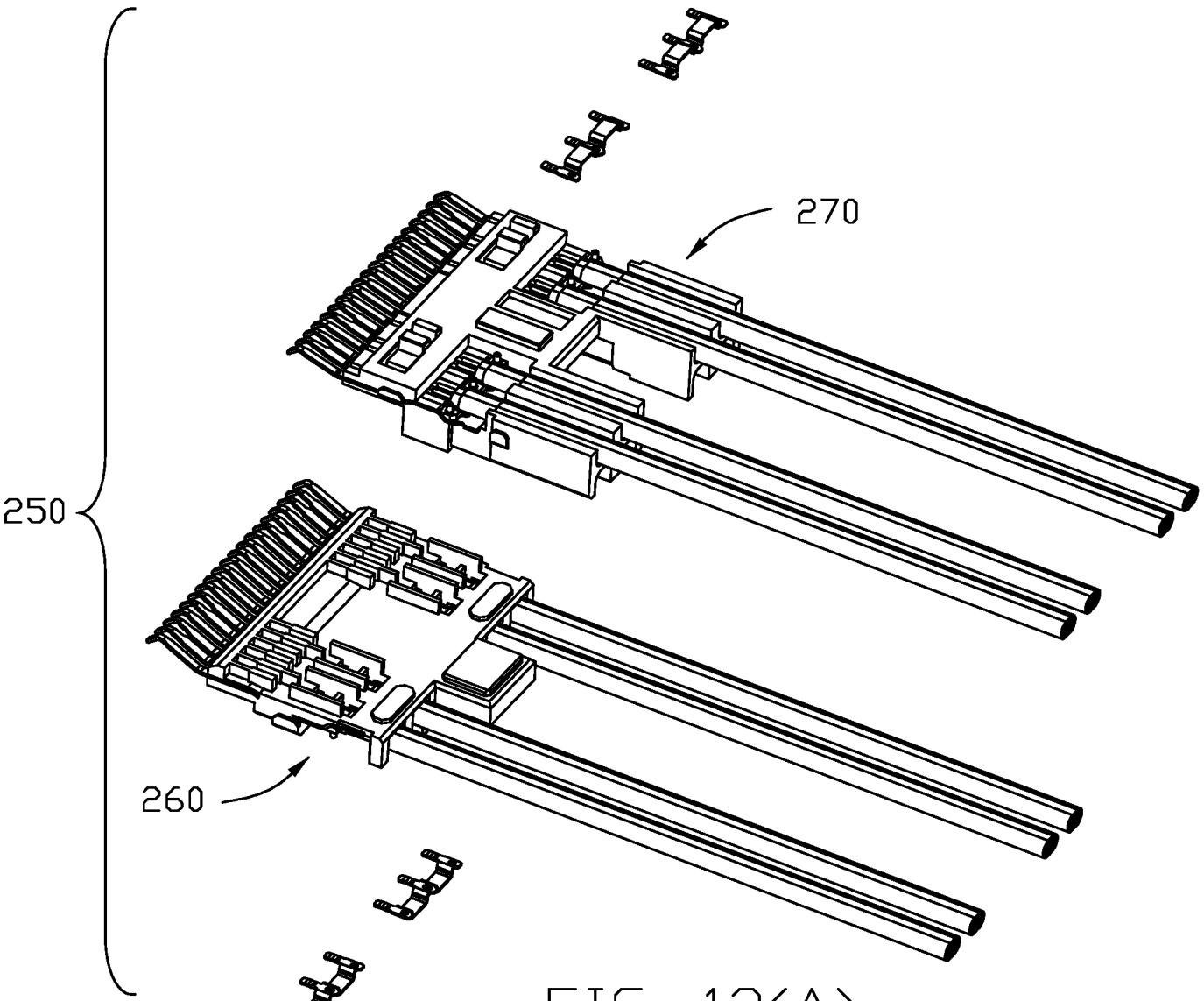
FIG. 12(A) is an exploded perspective view of the lower part of the contact module of the electrical connector assembly of FIG. 10(A)
Figure 12B:
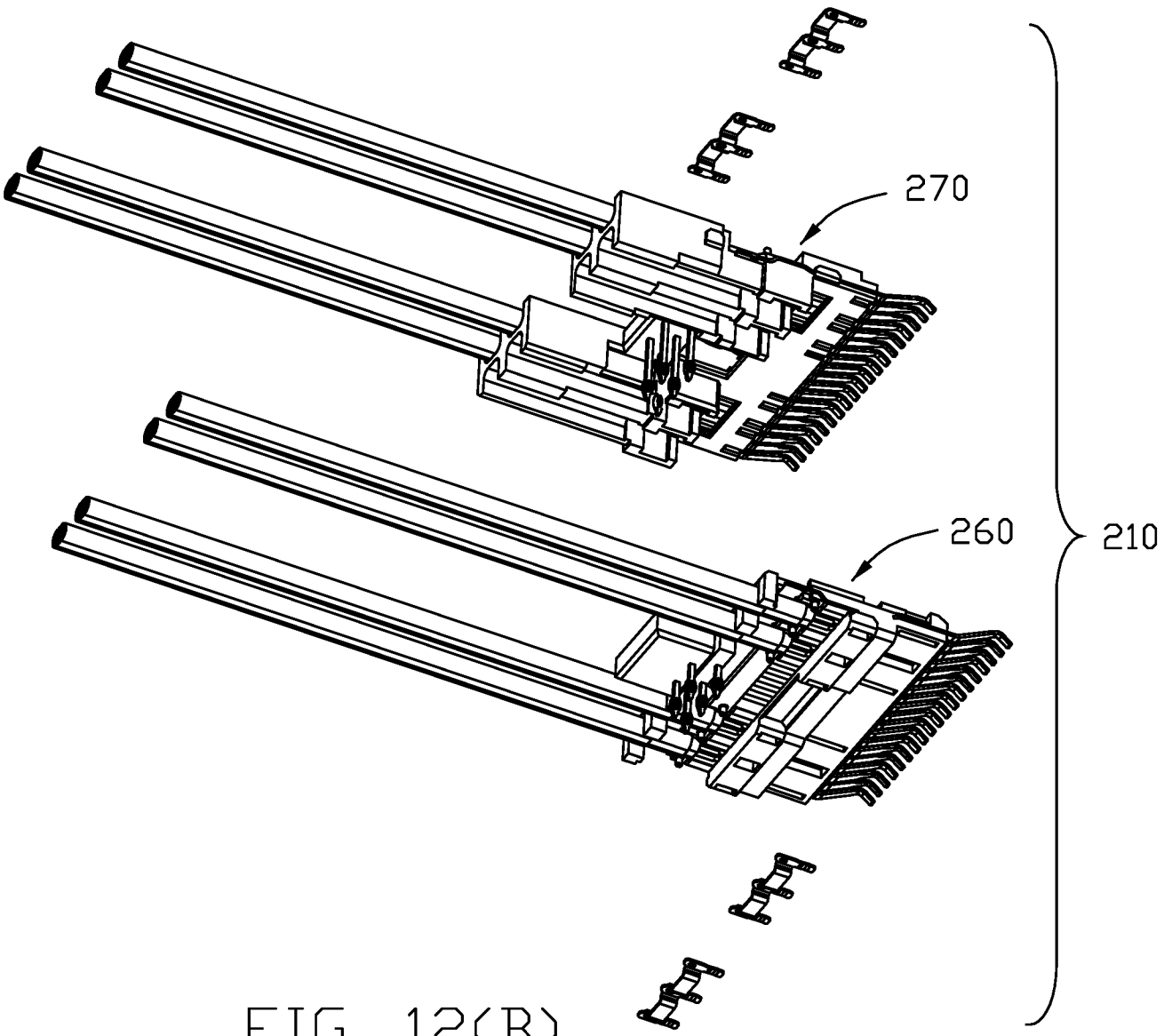
FIG. 12(B) is another exploded perspective view of the lower part of the contact module of the electrical connector assembly of FIG. 12(A)
Figure 13A:
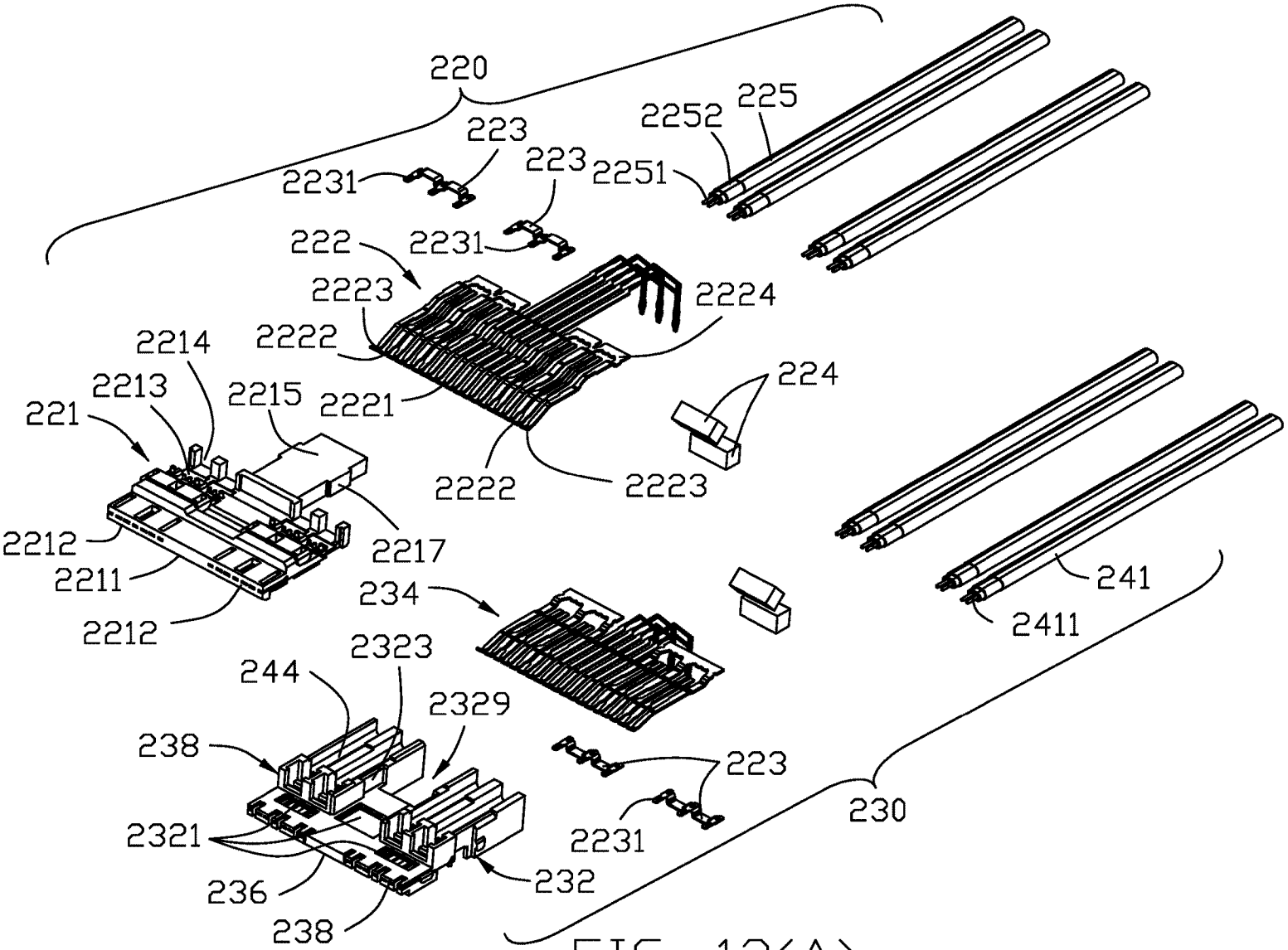
FIG. 13(A) is a further exploded perspective view of the upper part of the contact module of the electrical connector assembly of FIG. 11(A)
Figure 13B:
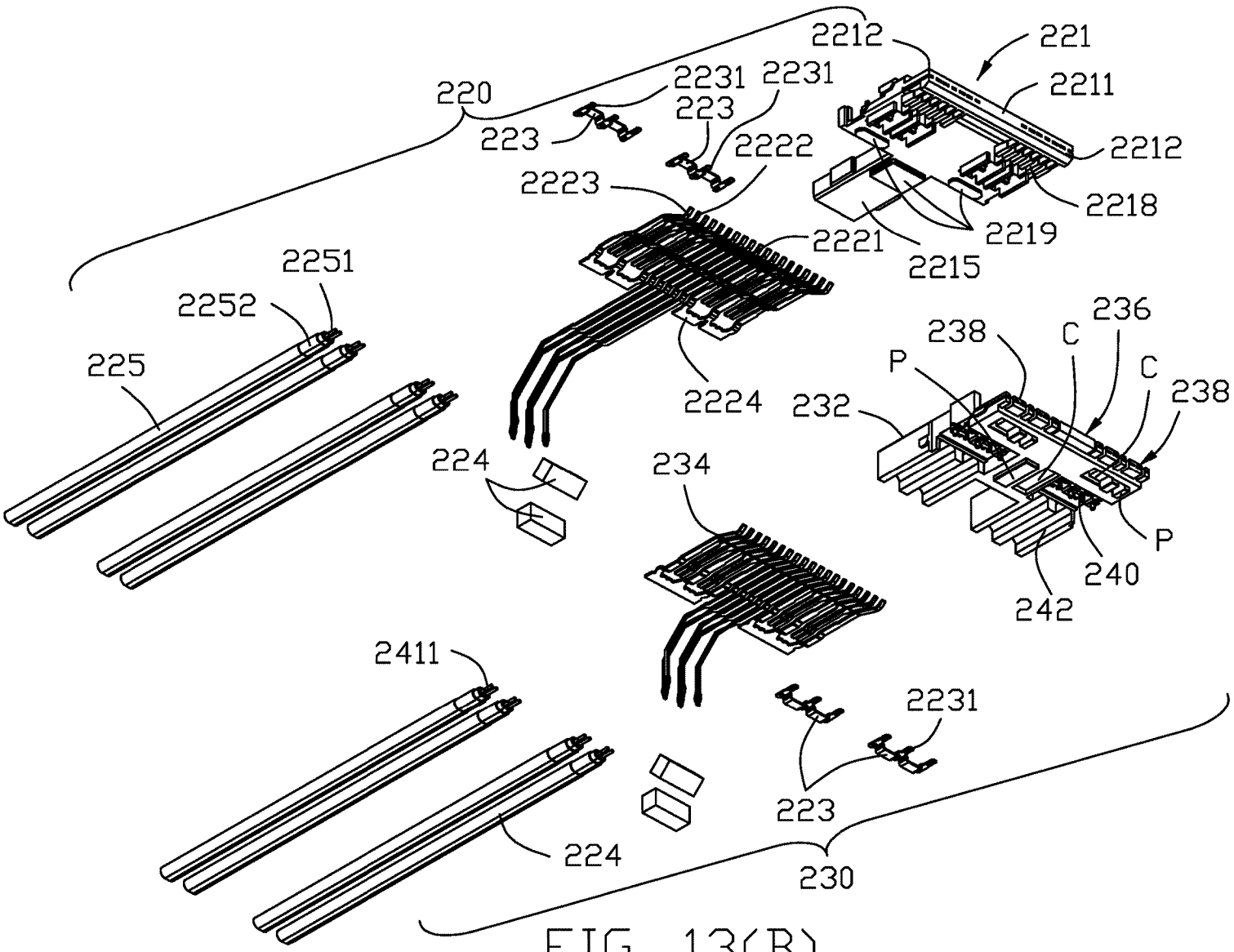
FIG. 13(B) is another exploded perspective view of the upper part of the contact module of the electrical connector assembly of FIG. 13(A)
Figure 14A:
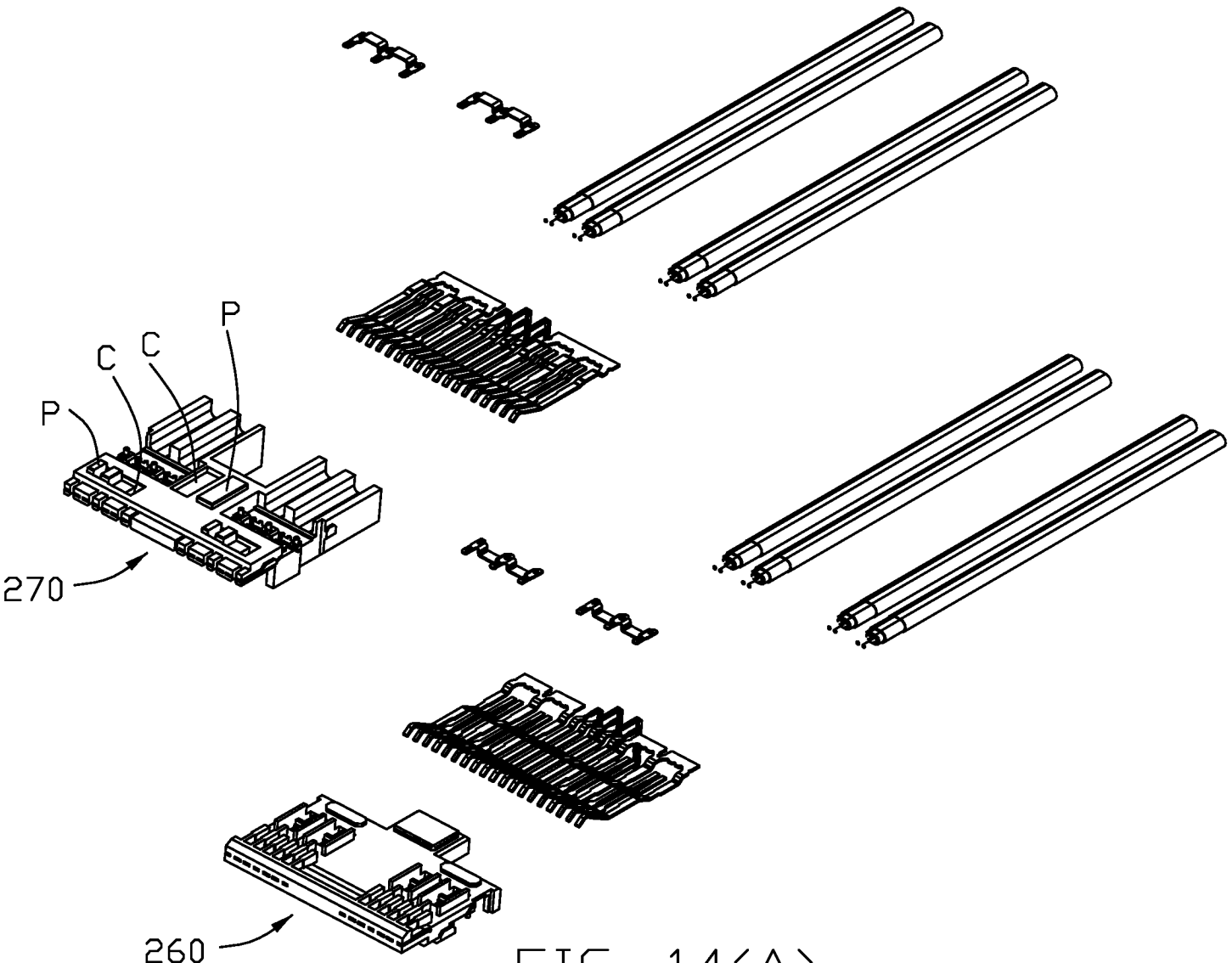
FIG. 14(A) is a further exploded perspective view of the lower part of the contact module of the electrical connector assemble of FIG. 12(A)
Figure 14B:
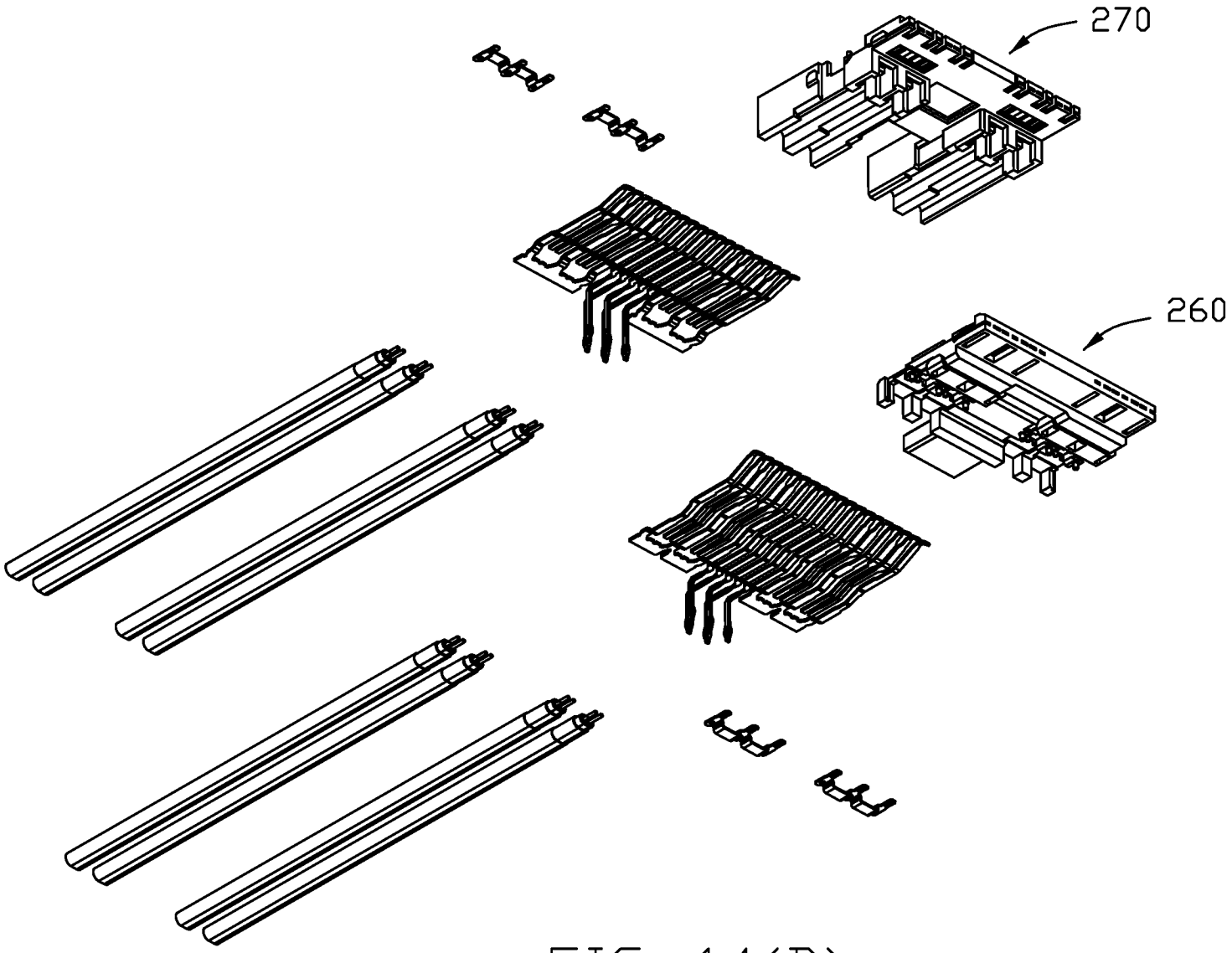
FIG. 14(B) is another exploded perspective view of the lower part of the contact module of the electrical connector assemble of FIG. 14(A)
Figure 15:
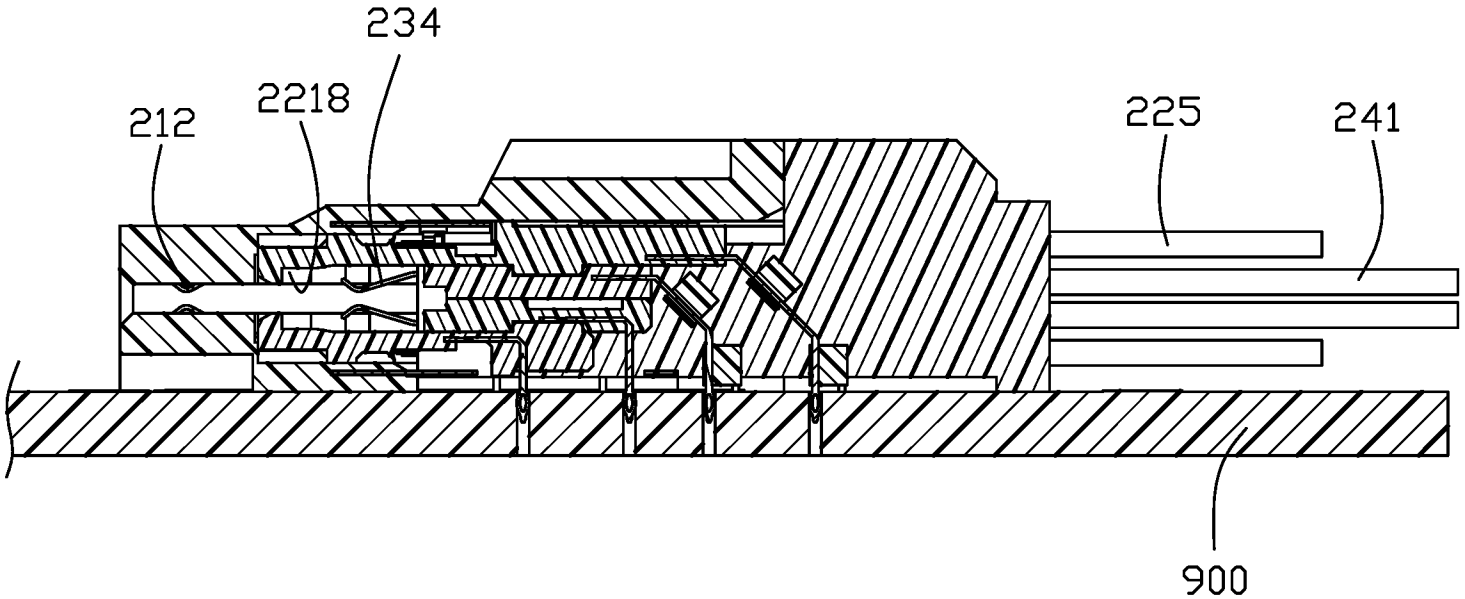
FIG. 15 is a cross-sectional view of the electrical connector assembly mounted upon the printed circuit board of FIG. 1.
Figure 16:
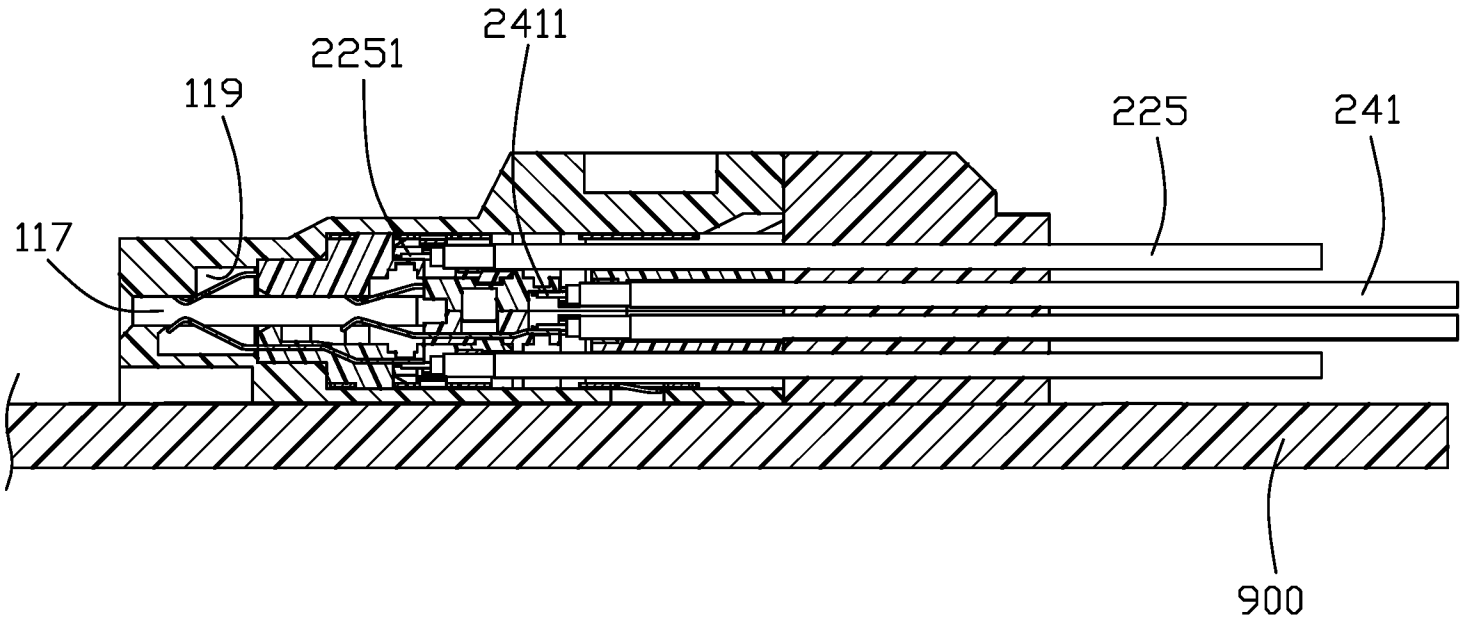
FIG. 16 is another cross-sectional view of the electrical connector assembly mounted upon the printed circuit board of FIG. 1.

Referring to FIGS. 1-16, an electrical connector assembly 100 for mounting upon a printed circuit board (PCB) 900, includes an insulative housing 110 and a contact module 200 received within the housing 110. The contact module 200 includes an upper part 210 and a lower part 250 stacked with each other. The upper part 210 includes a front/outer upper unit 220 and a rear/inner upper unit 230 assembled together. The front/upper unit 220 includes a unitary insulative body 221 and a plurality of contacts 222 integrally formed within the insulative body 221 via an insert-molding process. The insulative body 221 includes a middle sector 2211 and a pair of side sectors 2212. The contacts 222 include a plurality of side-band contacts 2221 retained in the middle sector 2211 to form a side-band contact zone 2201, and a plurality of differential-pair contacts 2222 retained in the side sectors 2212 to form a pair of differential-pair contact zones 2202 by two sides of the side-band contact zone 2201. The side sector 2212 forms a plurality of grooves 2213 to receive the tail sections of the differential-pair contacts 2222, and a plurality of slots 2214 aligned with the corresponding grooves 2213 to receive the wires 225. The wire 225 includes a pair of inner conductors 2251 be soldered to the tail of the corresponding differential-pair contacts 2222. The contacts 222 further include a plurality of grounding contacts 2223 alternately arranged with the corresponding differential-pair contacts 2222. The grounding contacts 2223 are unified together via a rear transverse bar 2224. In this embodiment, the contacts 222 include one set of side-band contacts 2221 and two sets of differential-pair contacts 2222 by two sides of the side-band contacts 2221 in the transverse direction, wherein the set of side-band contacts 2221 include five pieces, and each set of differential-pair contacts 2222 include two pairs of the differential-pair contacts 2222 alternately arranged with three grounding contacts 2223. Each differential-pair contact zone 2202 is further equipped with a metallic grounding bracket 223 to cooperate with the corresponding transverse bar 2224 to sandwich the braiding layer 2252 therebetween in the vertical direction wherein the grounding bracket 223 and the transverse bar 2224 are soldered with the braiding layer 2252. Notably, the grounding bracket 223 includes three forwardly extending extensions 2231 to mechanically and electrically connect the corresponding grounding contacts 2223, respectively. The middle sector 2211 further includes a rearward extension 2215 to hold the rearward lengthened tail sections of the side-band contacts 2221. A pair of spacers 224 are integrally formed on the tail sections of the side-band contacts 2221 for securing consideration. Notably, the front deflectable contacting sections of the contacts 222 are exposed in front of the front edge of the insulative body 221.

The basic structure/arrangement of the rear/inner upper unit 230 is essentially similar to that of the front/outer upper unit 220 and includes the insulative body 232 and a plurality of contacts 234 integrally formed with the insulative body 232 via insert-molding. The rear/inner upper unit 230 also forms the middle side-band contact zone 236 and a pair of differential-pair contact zones 238 by two sides. The lower side of the differential-pair contact zone 238 forms a plurality of grooves 240 to receive the tail sections of the differential-pair contacts of the contacts 234 and the inner conductors of the corresponding wires 241, and a plurality of slots 242 aligned with the corresponding grooves 240 to receive the corresponding wires 242. The upper side of the differential-contact zone 238 forms a plurality of slots 244 aligned with the corresponding slots 2214 of the front/outer upper unit 220 to receive the wires 225 of the front/outer upper unit 230. The underside of the insulative body 221 of the front/outer upper unit 220 includes a plurality of protrusions 2219, and the upper side of the insulative body 232 of the rear/inner upper unit 230 forms a plurality of recesses 2321 to receive the corresponding protrusions 2219 when assembled. The rearward extension 2215 of the front/outer upper unit 220 is received within a space 2329 formed in a middle region the rear/inner upper unit, and further forms a pair of sideward protrusions 2217 to be received/engaged within the corresponding recesses 2322 by two sides of the space 2329 when assembled. The underside of the insulative body 221 of the front/outer upper unit 220 further forms a plurality of grooves 2218 to respectively receive the front deflectable contacting sections of the contacts 234 of the rear/inner upper unit 230 so as to allow the front deflectable contacting section of the contact 234 up-and-down deflectable. Other portions of the rear/inner upper unit 230 are arranged similar to those of the front/outer upper unit 220. When assembled to form the upper part 210, the insulative body 221 of the front/outer upper unit 220 is stacked upon the insulative body 232 of the rear/inner upper unit 230 upwardly and forwardly, the front deflectable contacting sections of the contacts 222 of the front/outer upper unit 220 are located in front of those of the contacts 234 of the rear/inner upper unit 230. In the front/outer upper unit 220, the inner conductors 2251 of the wires 225 are soldered with the tail sections of the contacts 222 around an upper side of the insulative body 221 while in the rear/inner upper unit 230, the inner conductors 2411 of the wires 241 are soldered with the tail sections of the contacts 234 around an underside of the insulative body 232.

The arrangement of the lower part 250 is similar to that of the upper part 210, and includes a front/outer lower unit 260 and a rear/inner lower unit 270 stacked with each other with the similar relationship defined in the upper part 210. In other words, each unit 250, 260 includes the insulative body and a plurality of contacts integrally formed with the insulative body via insert-molding. Each unit 260, 270 also forms the side-band contact zone and the pair of differential-pair contact zones on two sides. Notably, the upper part 210 and the lower part 250 are essentially arranged in a mirror image manner in the vertical direction, including extension of the contacts and the stacking of the front/outer unit and the rear/inner unit, except the tail sections of the contacts of both the upper part 210 and the lower part 250 extend downwardly instead of oppositely. It is also noted that, to assemble the upper part 210 and the lower part 250 together, the underside of the insulative body 232 of the rear/inner upper unit 230 forms downward protrusions P and an upward recesses C. Correspondingly, the upper side of the insulative body of the rear/inner lower unit 270 also forms the upward protrusions P and the downward recesses C for coupling consideration during assembling.

The contact module 200 further includes a pair of metallic shields 300, 310 respectively assembled upon the upper part 210 and the lower part 250. Each of the shields 300, 310 includes the spring tangs 304, 314 extending inwardly in the vertical direction to electrically and mechanically connect to the corresponding grounding brackets 223 for perfecting grounding. Each of the shields 300, 310 further includes extending finger 306, 316 to contact the other for make common grounding. The housing 110 includes a front mating slot 117 and a rear receiving space 115. Two rows of passageways 119 are formed by two sides of the mating slot 117. The contact module 200 is forwardly inserted into the receiving space 1115 of the housing 110 wherein the front deflectable contacting sections of the contacts 222 are received within the corresponding passageways 119, respectively, with the corresponding contacting points exposed in the mating slot 117 which receives a mating tongue of the complementary connector. The shields 300, 310 include engagement tabs 302, 312 to be received within the corresponding engagement holes 112 of the housing 110 so as to retain the contact module 200 within the housing 110.

A pair of metallic mounting legs 350 are secured on two sides of the housing 110. Each of the mounting legs 350 includes a spring finger 352 to mechanically and electrically connect the corresponding extending finger 306, 316 of the shields 300, 310 for common ground consideration, and a plurality of press-fit tails 354 for mounting to the PCB 900. In this embodiment, an over-molding cover 299 is applied upon a rear side of the contact module 200 so as to complete the whole assembly of the contact module 200.

Figure 17A:
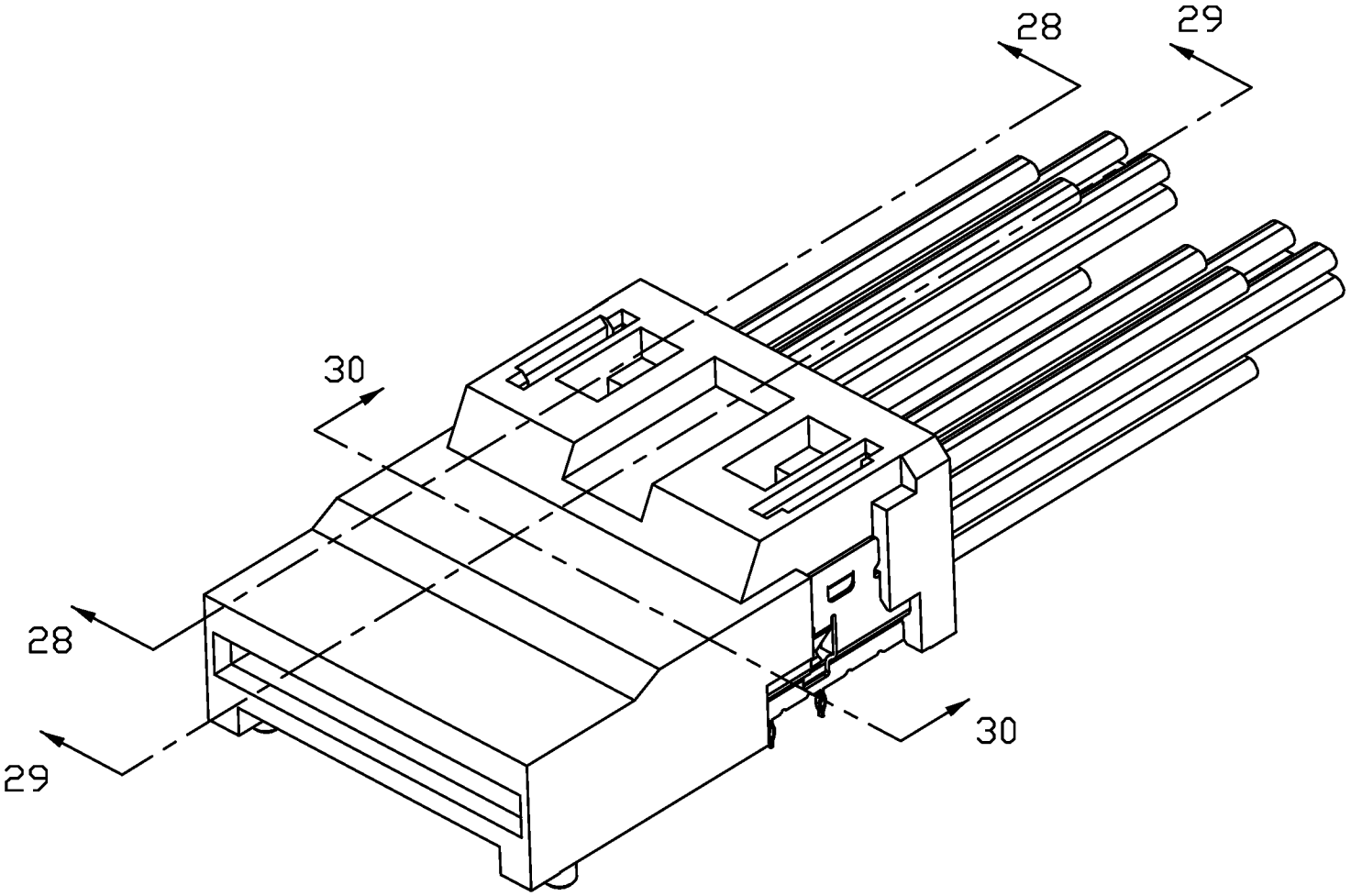
FIG. 17(A) is a perspective view of the electrical connector assembly according to another embodiment of the invention.
Figure 17B:
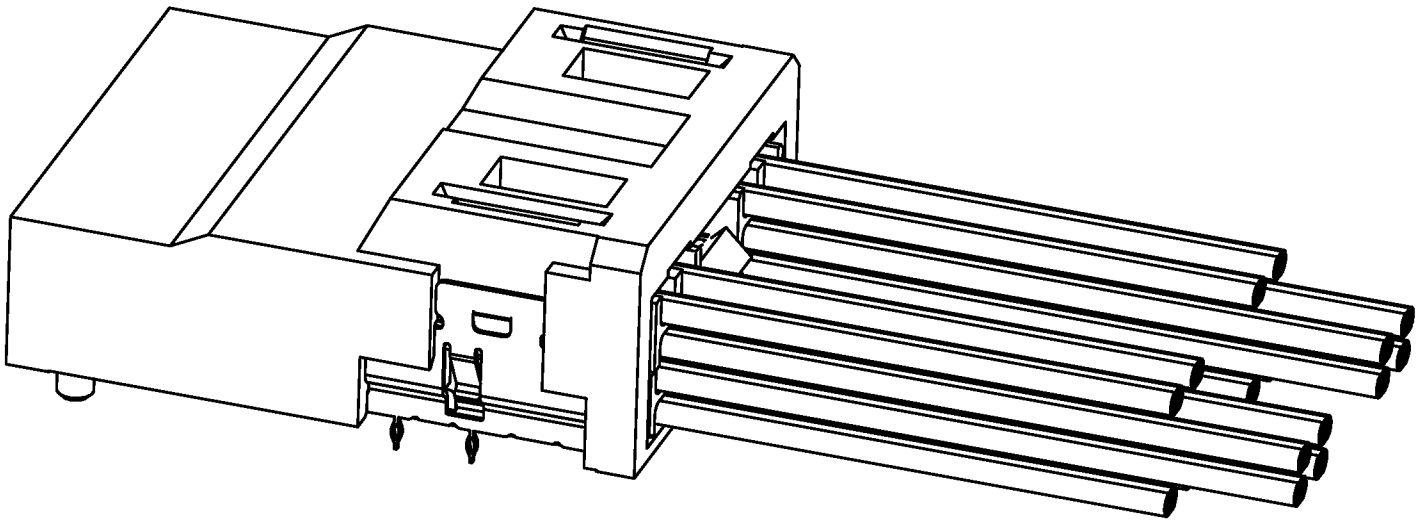
FIG. 17(B) is another perspective view of the electrical connector assembly of FIG. 17(A)
Figure 17C:
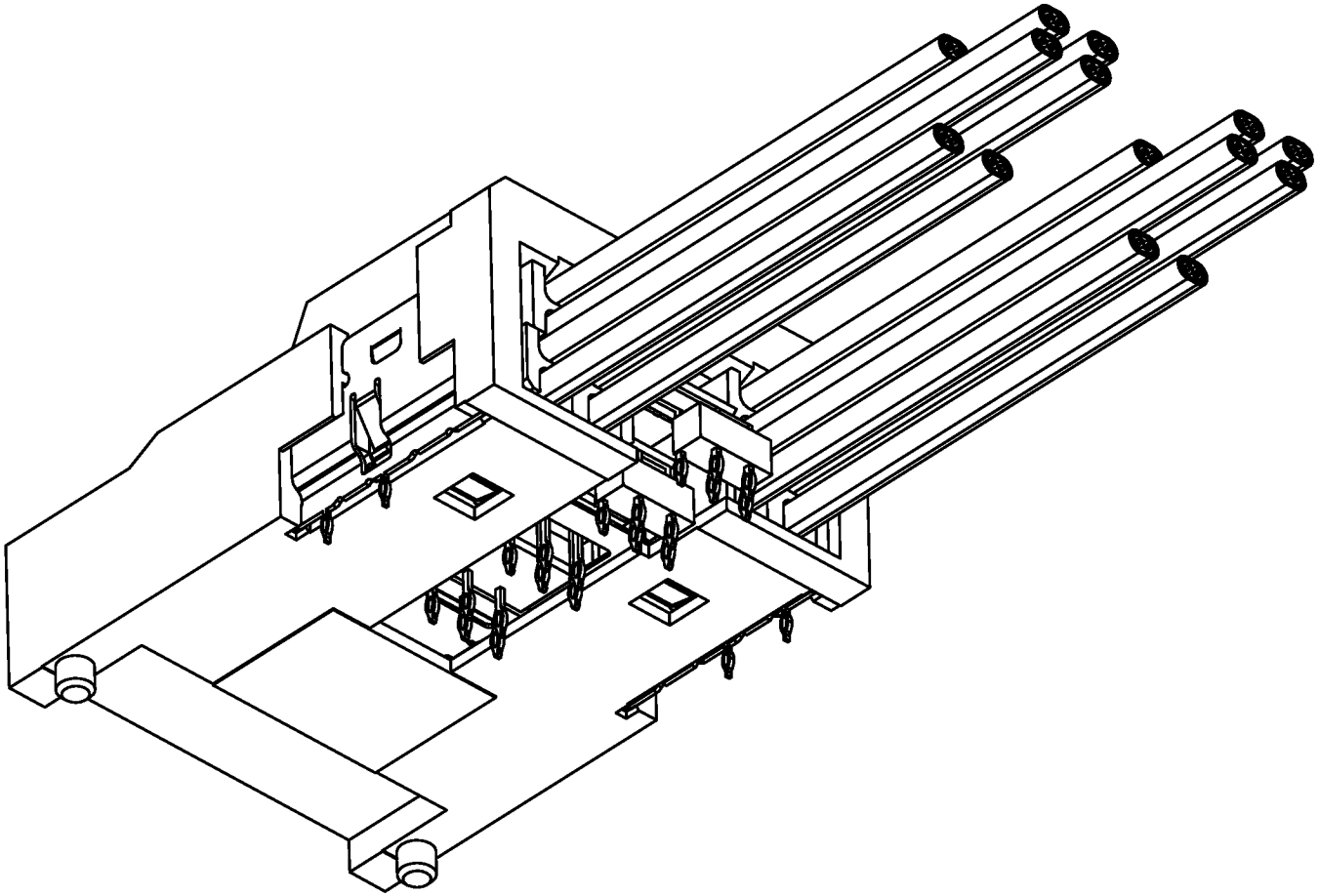
FIG. 17(C) is another exploded perspective view of the electrical connector assembly of FIG. 17(A)
Figure 18A:
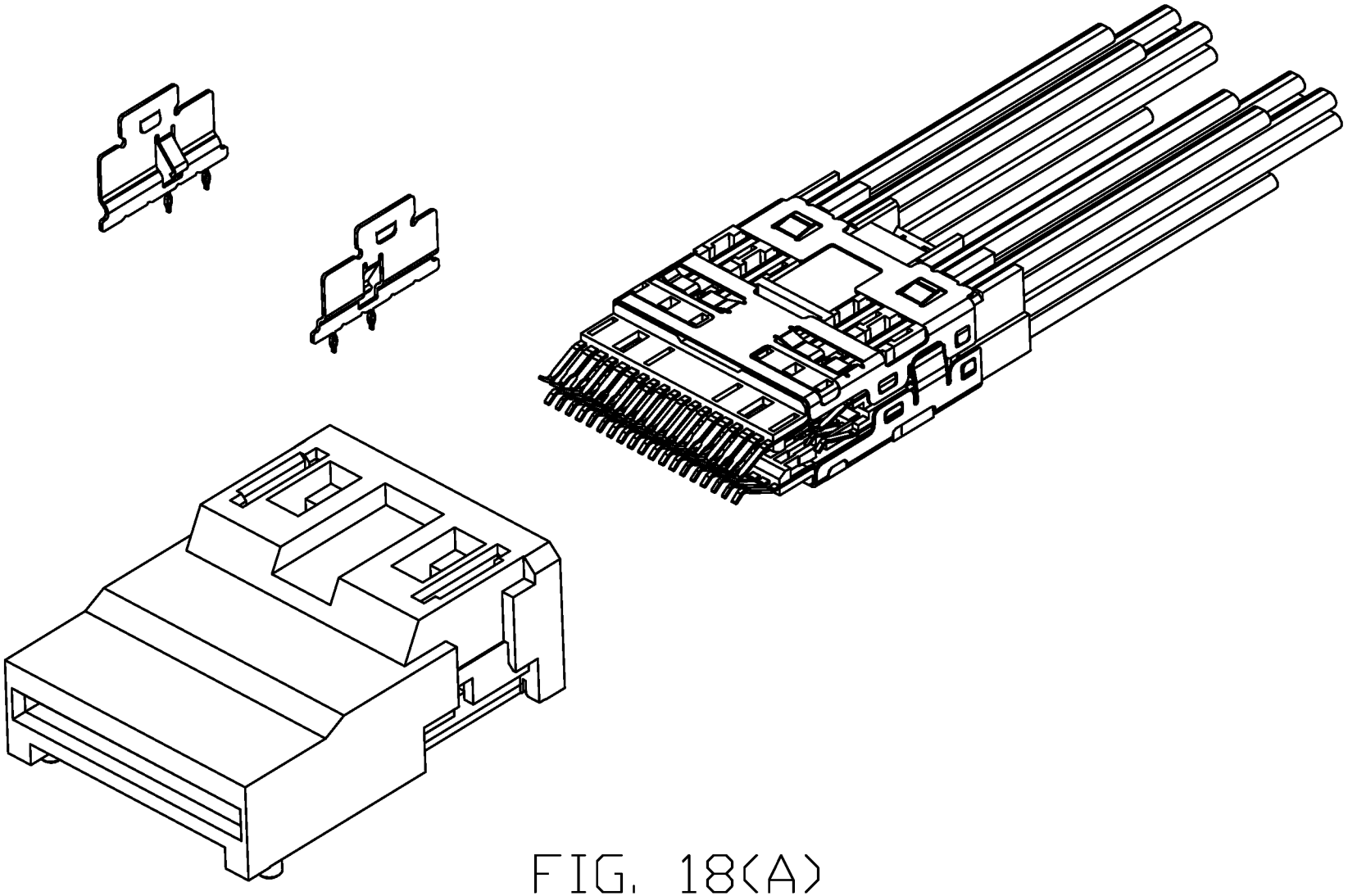
FIG. 18(A) is an exploded perspective view of the electrical connector assembly of FIG. 17(A)
Figure 18B:
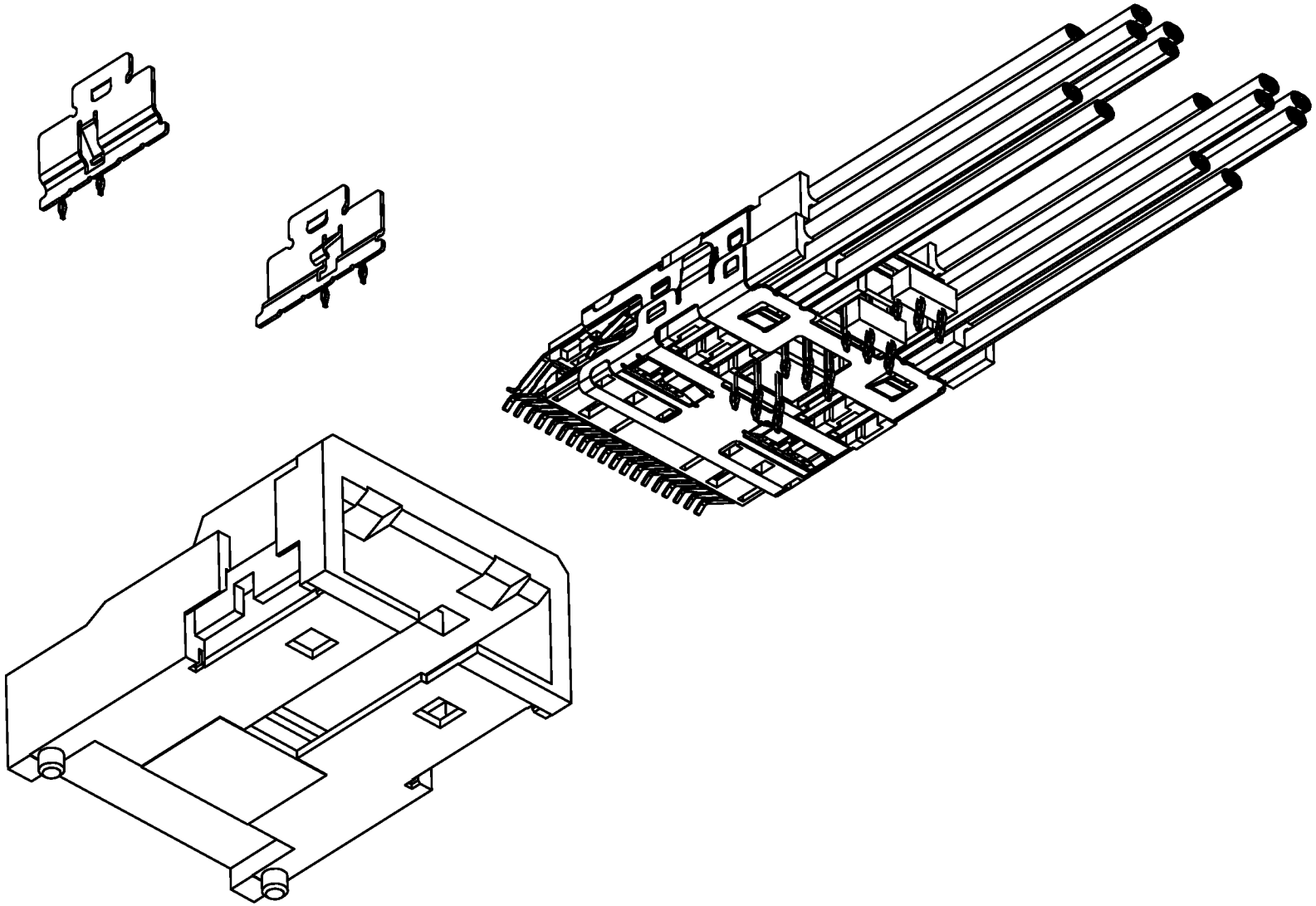
FIG. 18(B) is another exploded perspective view of the electrical connector assembly of FIG. 18(A)
Figure 19A:
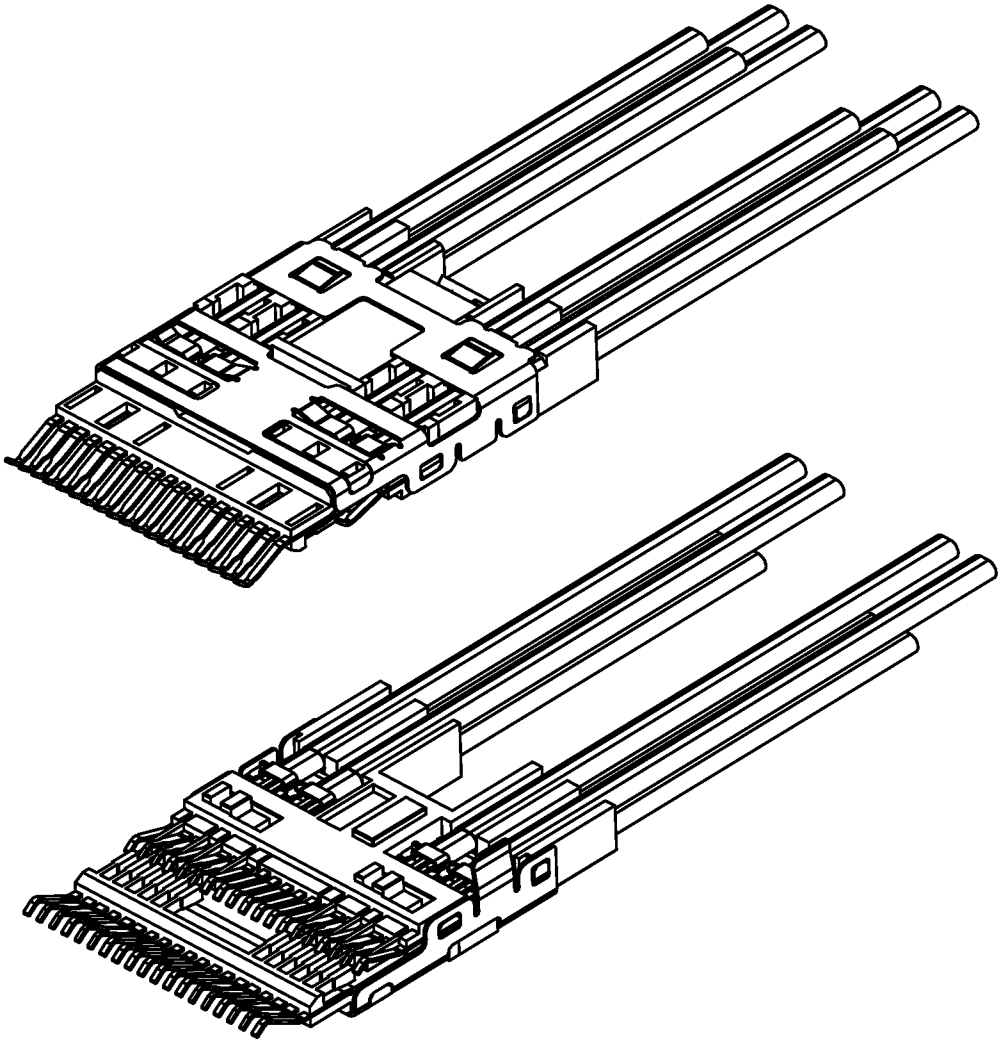
FIG. 19(A) is an exploded perspective view of the contact module of the electrical connector assembly of FIG. 18(A) wherein the upper part and the lower part are separated from each other.
Figure 19B:
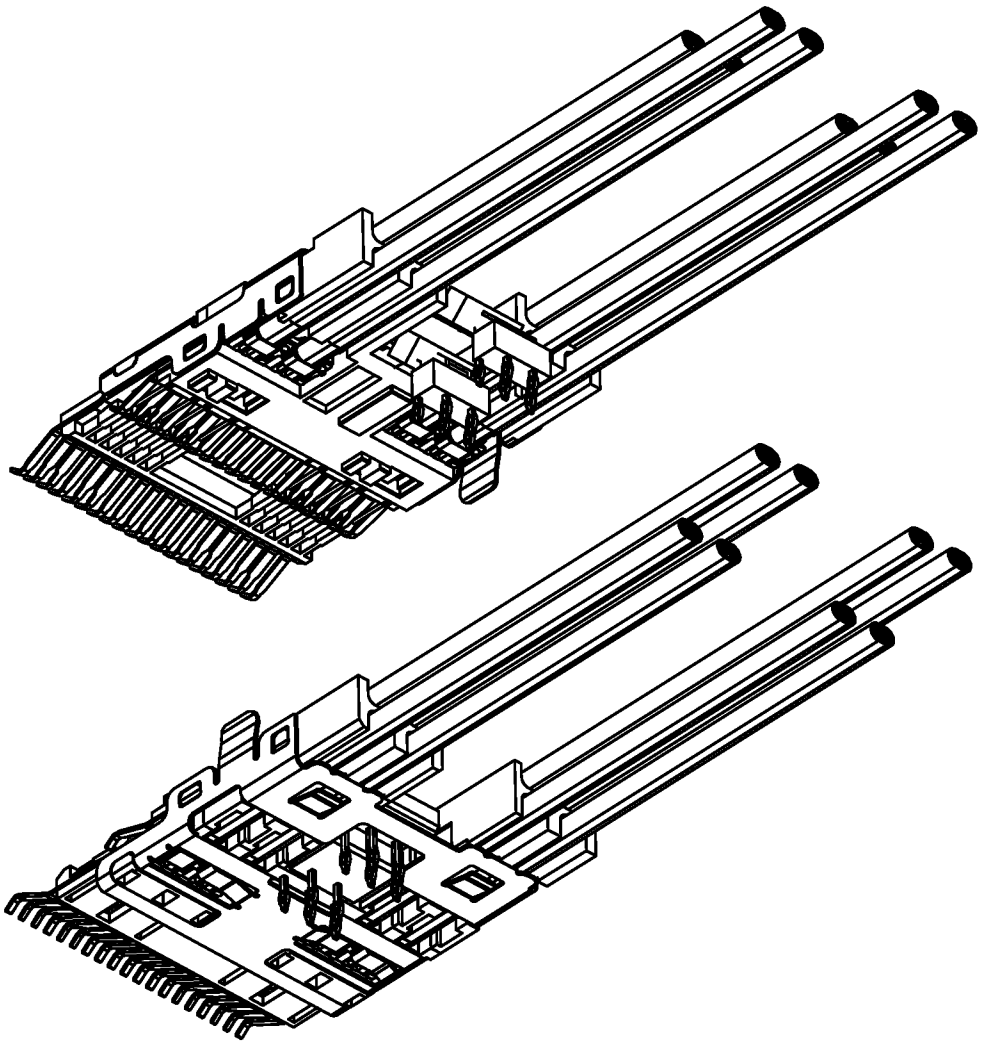
FIG. 19(B) is another exploded perspective view of the contact module of the electrical connector assembly of FIG. 19(A)
Figure 20A:
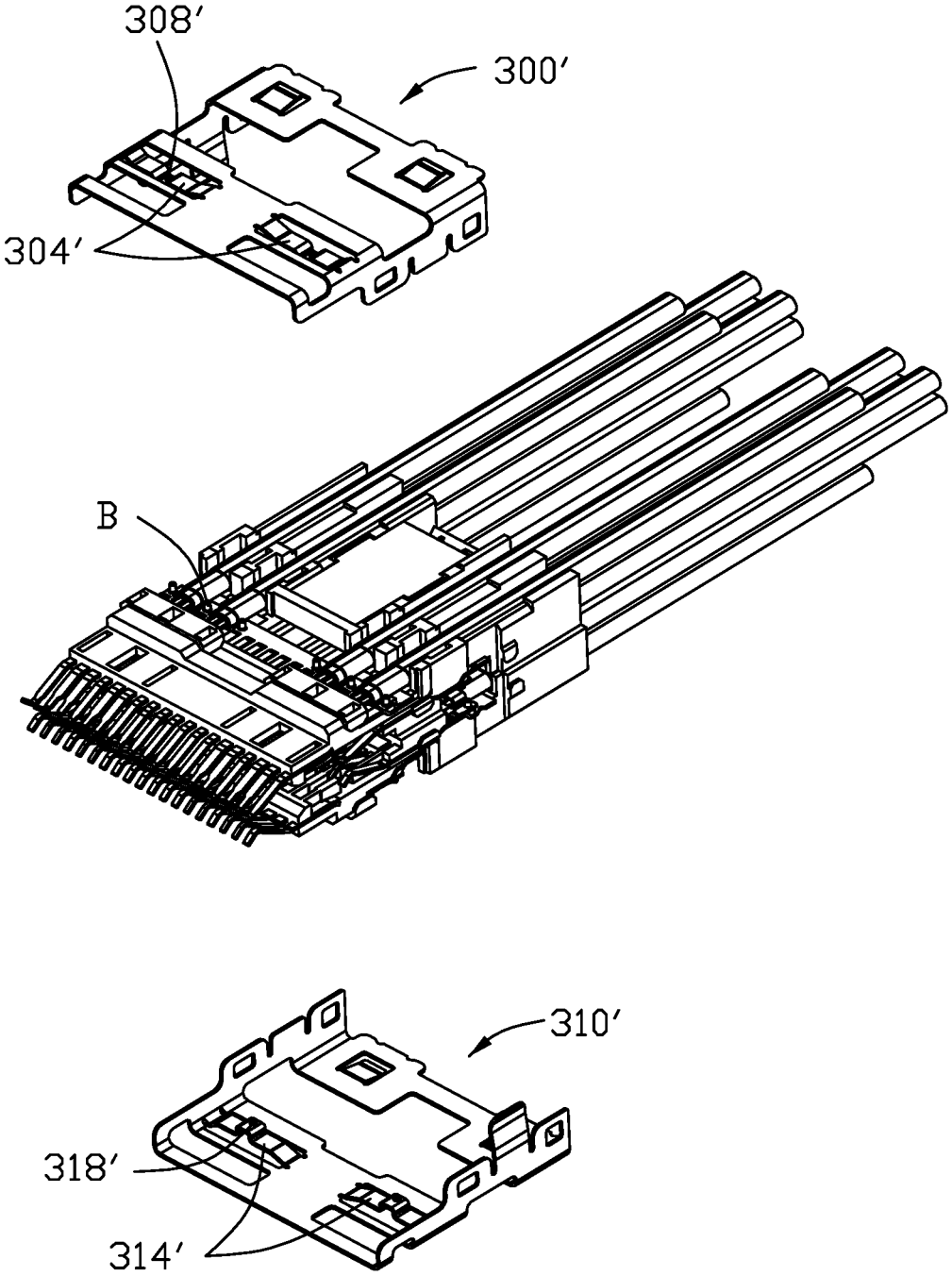
FIG. 20(A) is an exploded perspective view of the contact module of the electrical connector assembly of FIG. 18(A) wherein the metallic shields are removed away from the four-layer structure thereof.
Figure 20B:
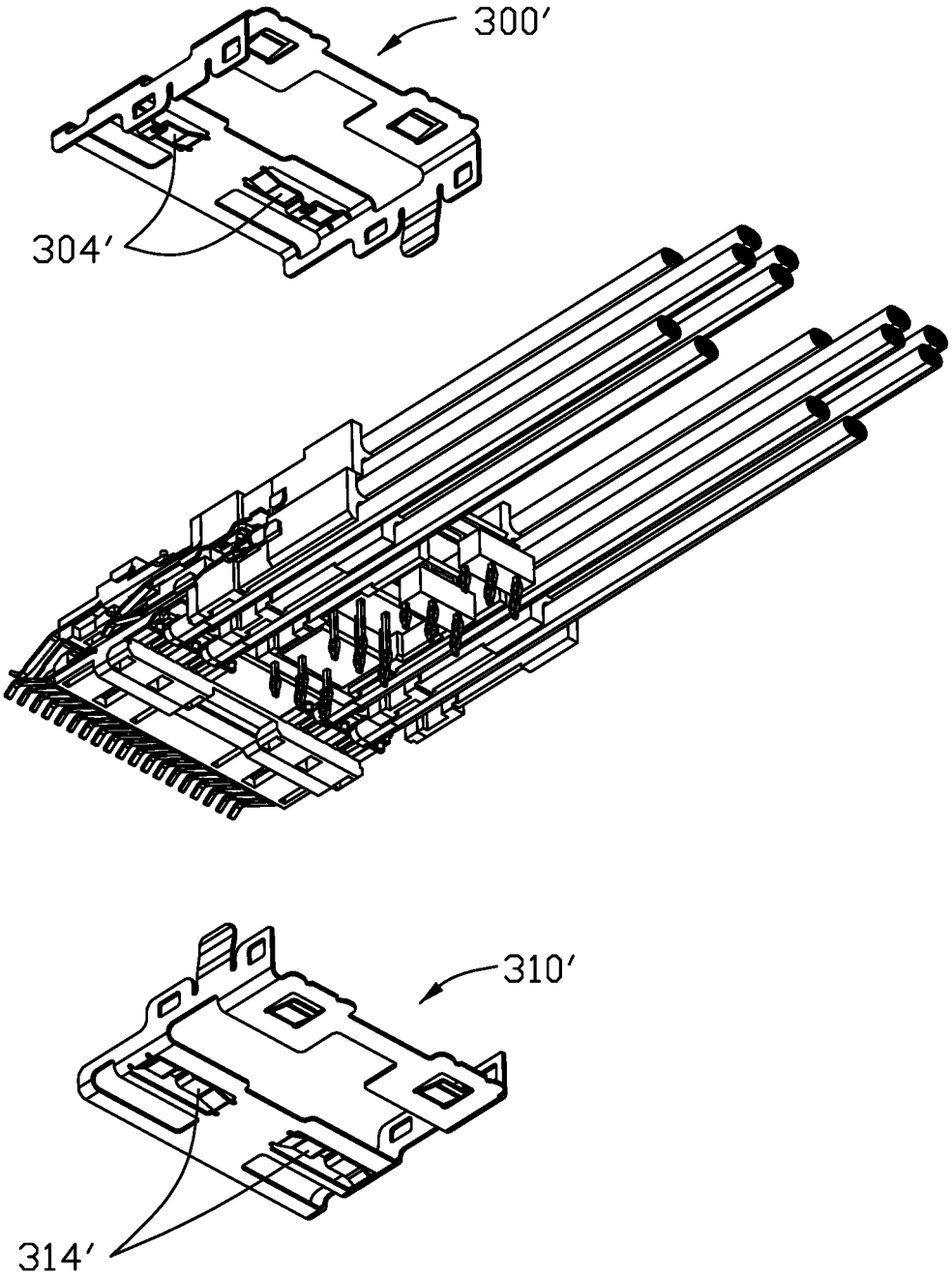
FIG. 20(B) is another exploded perspective view of the contact module of the electrical connector assembly of FIG. 20(A)
Figure 21:
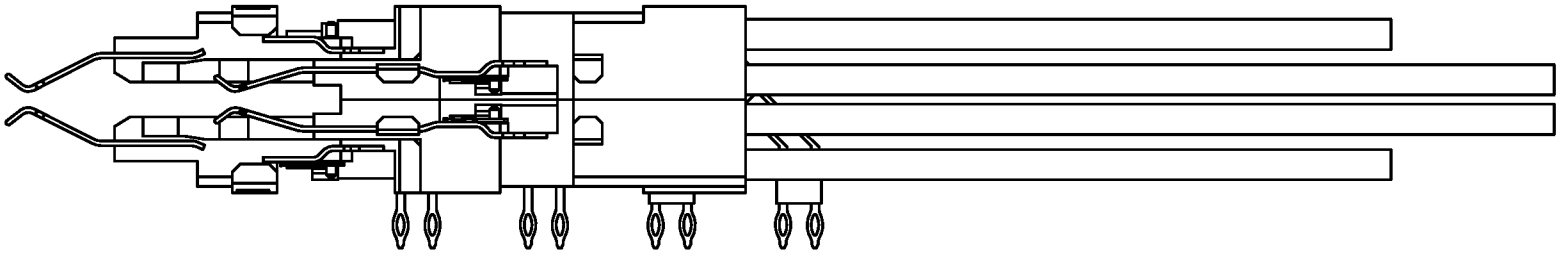
FIG. 21 is a rough side view of the contact module of the electrical connector assembly of FIG. 17(A)
Figure 22A:
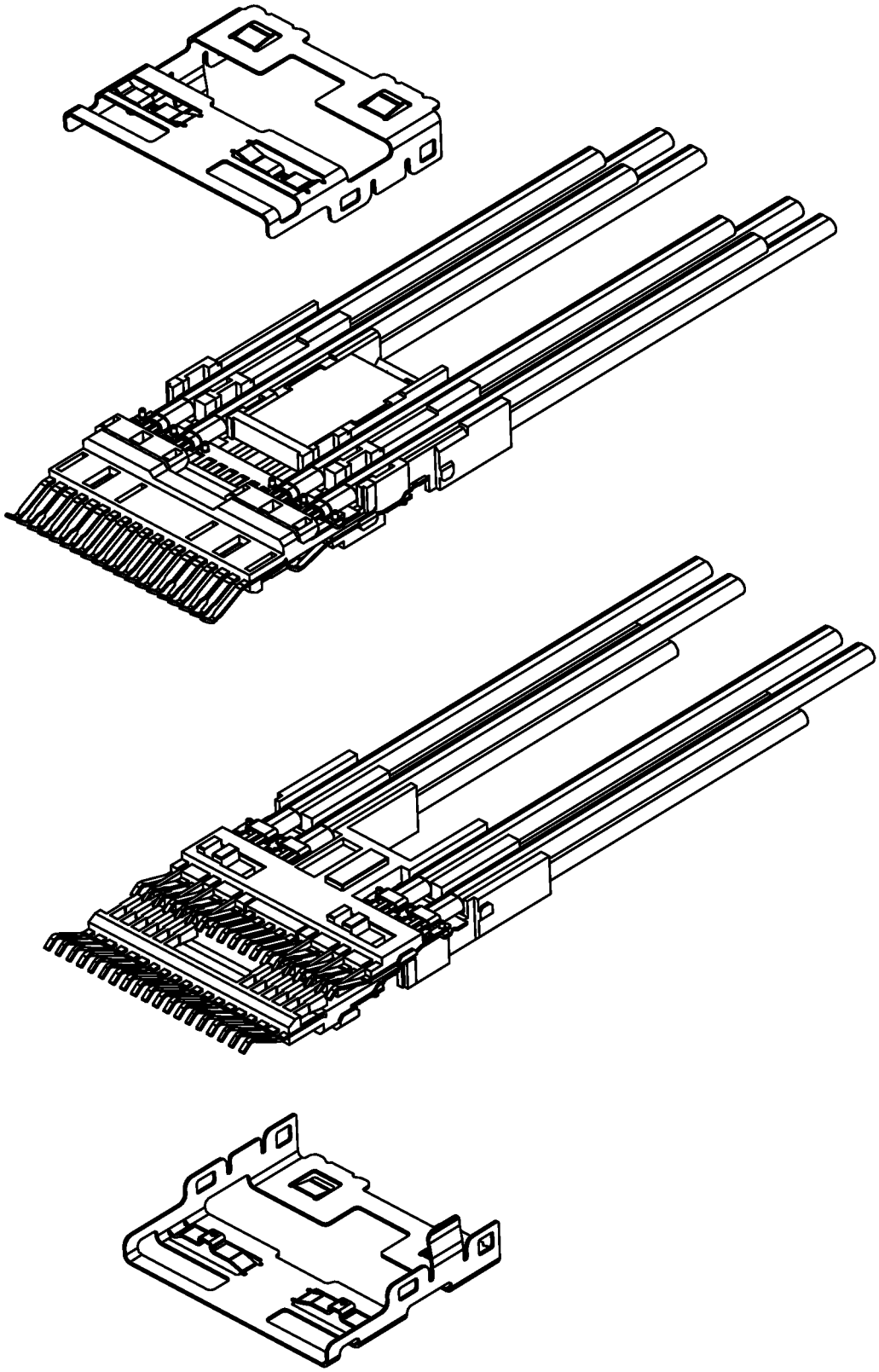
FIG. 22(A) is a further exploded perspective view of the contact module of the electrical connector assembly of FIG. 20(A)
Figure 22B:
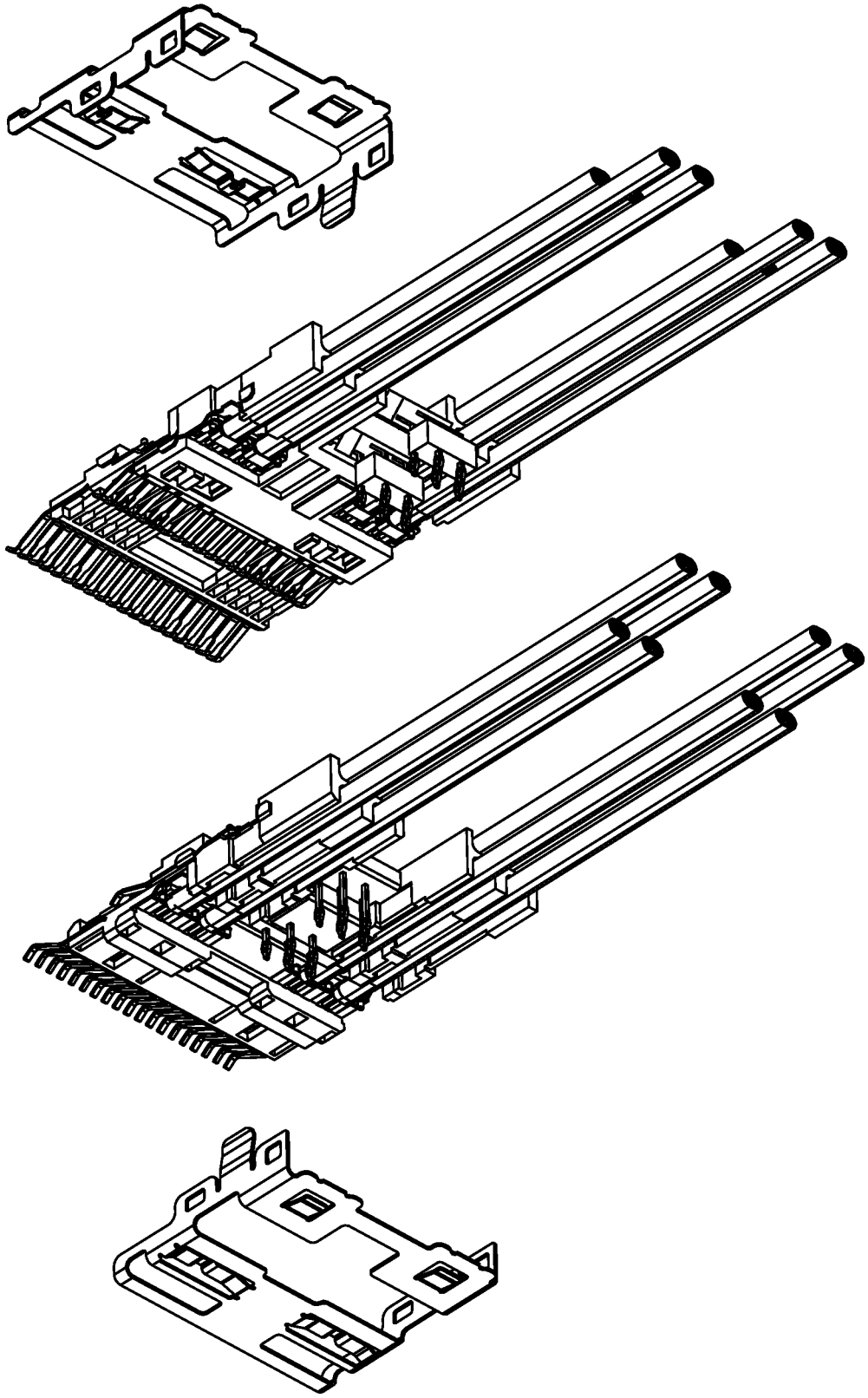
FIG. 22(B) is another exploded perspective view of the contact module of the electrical connector assembly of FIG. 22(A)
Figure 23A:
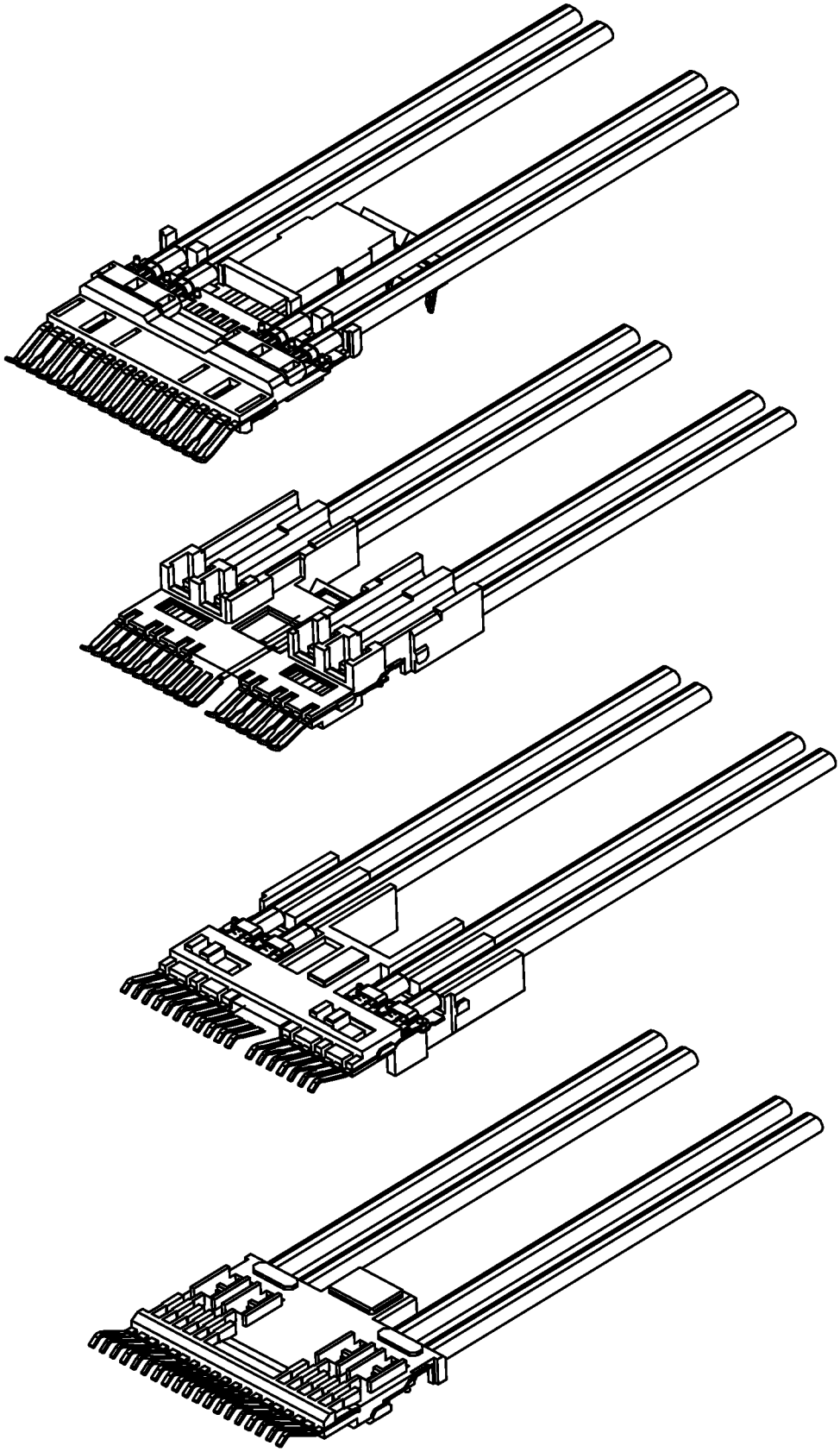
FIG. 23(A) is a further exploded perspective view of the contact module of the electrical connector assembly of FIG. 22(A)
Figure 23B:
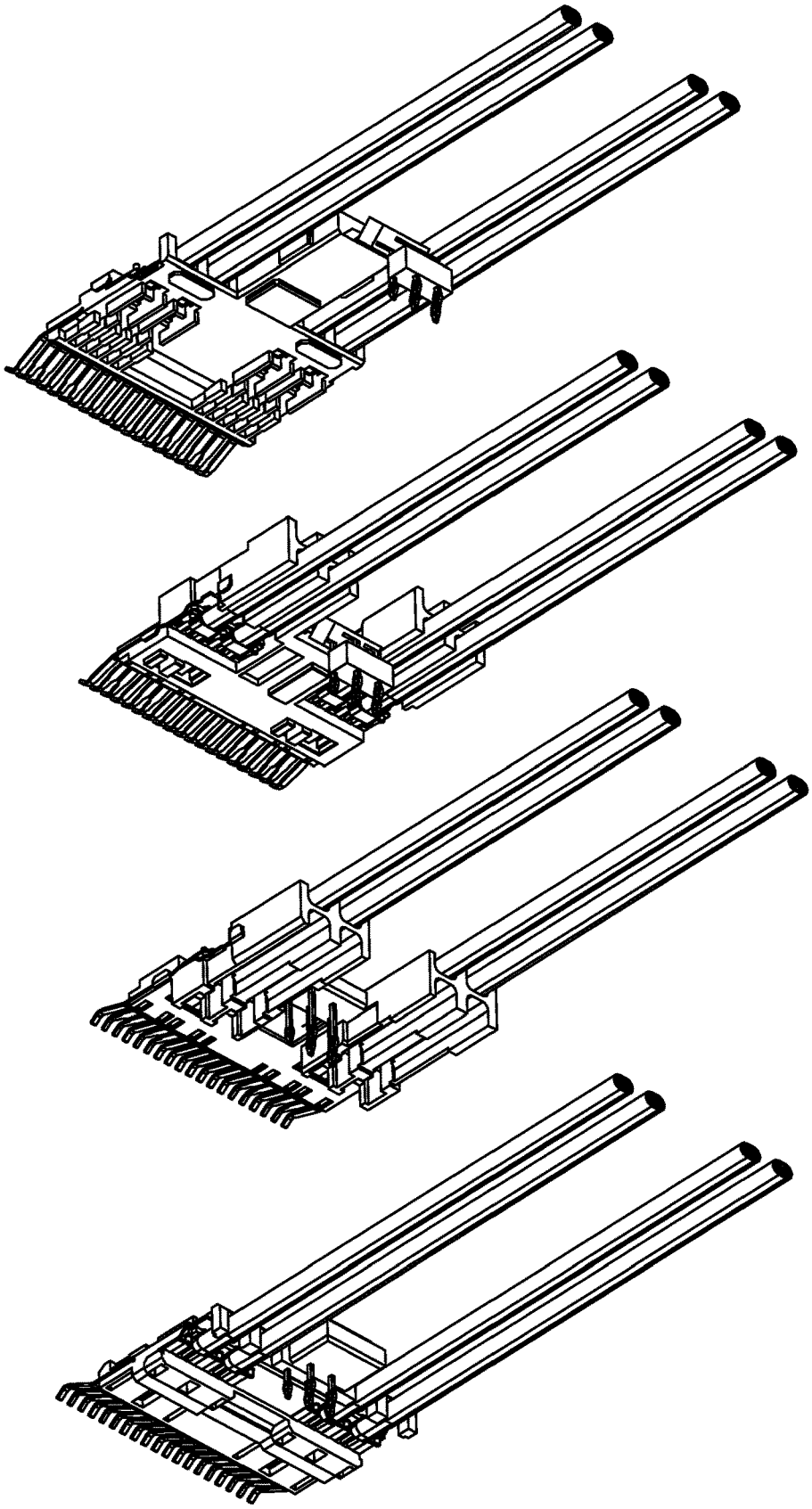
FIG. 23(B) is another exploded perspective view of the contact module of the electrical connector assembly of FIG. 23(A)
Figure 24A:
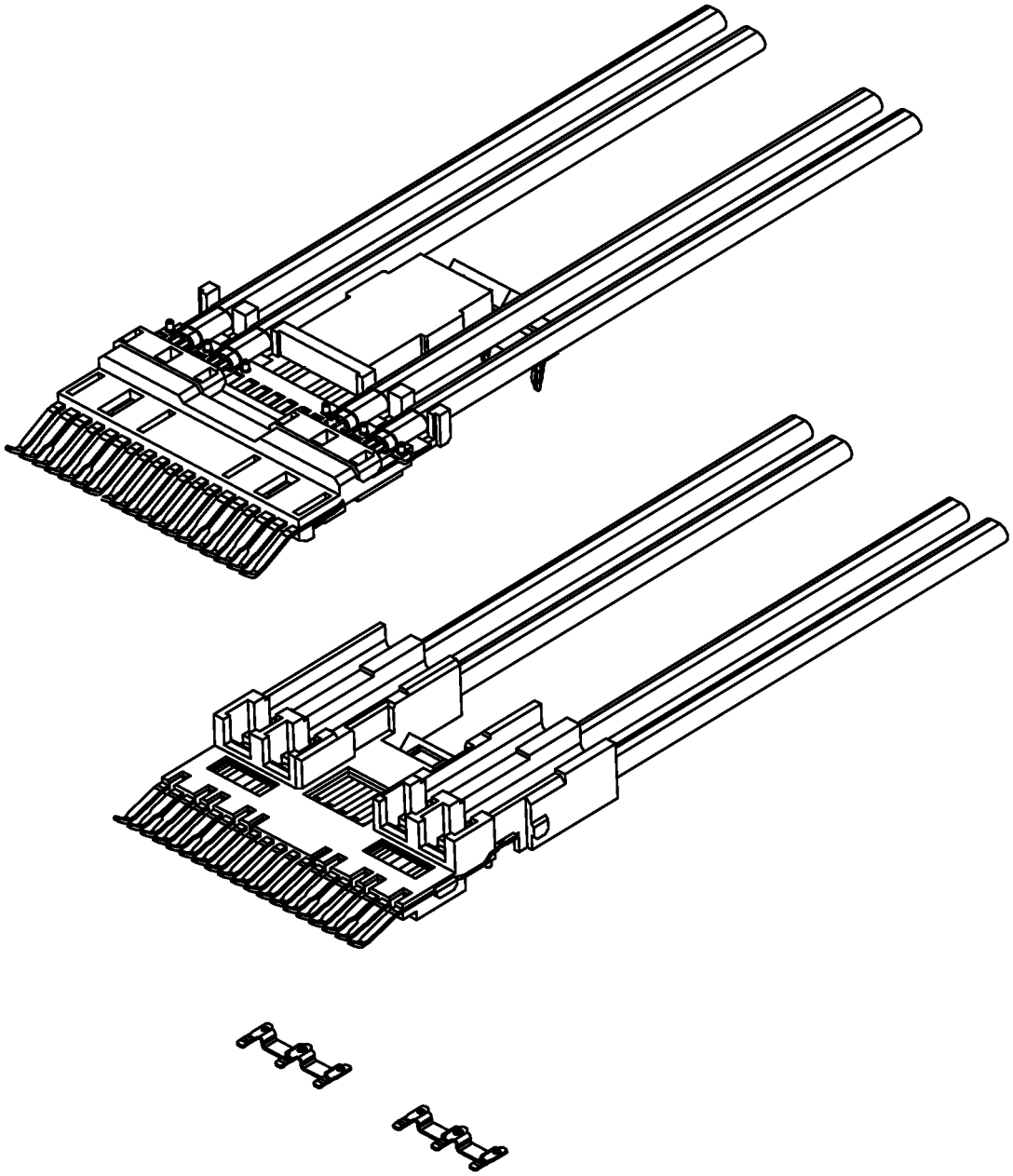
FIG. 24(A) is an exploded perspective view of the upper part of the contact module of the electrical connector assembly of FIG. 23(A)
Figure 24B:
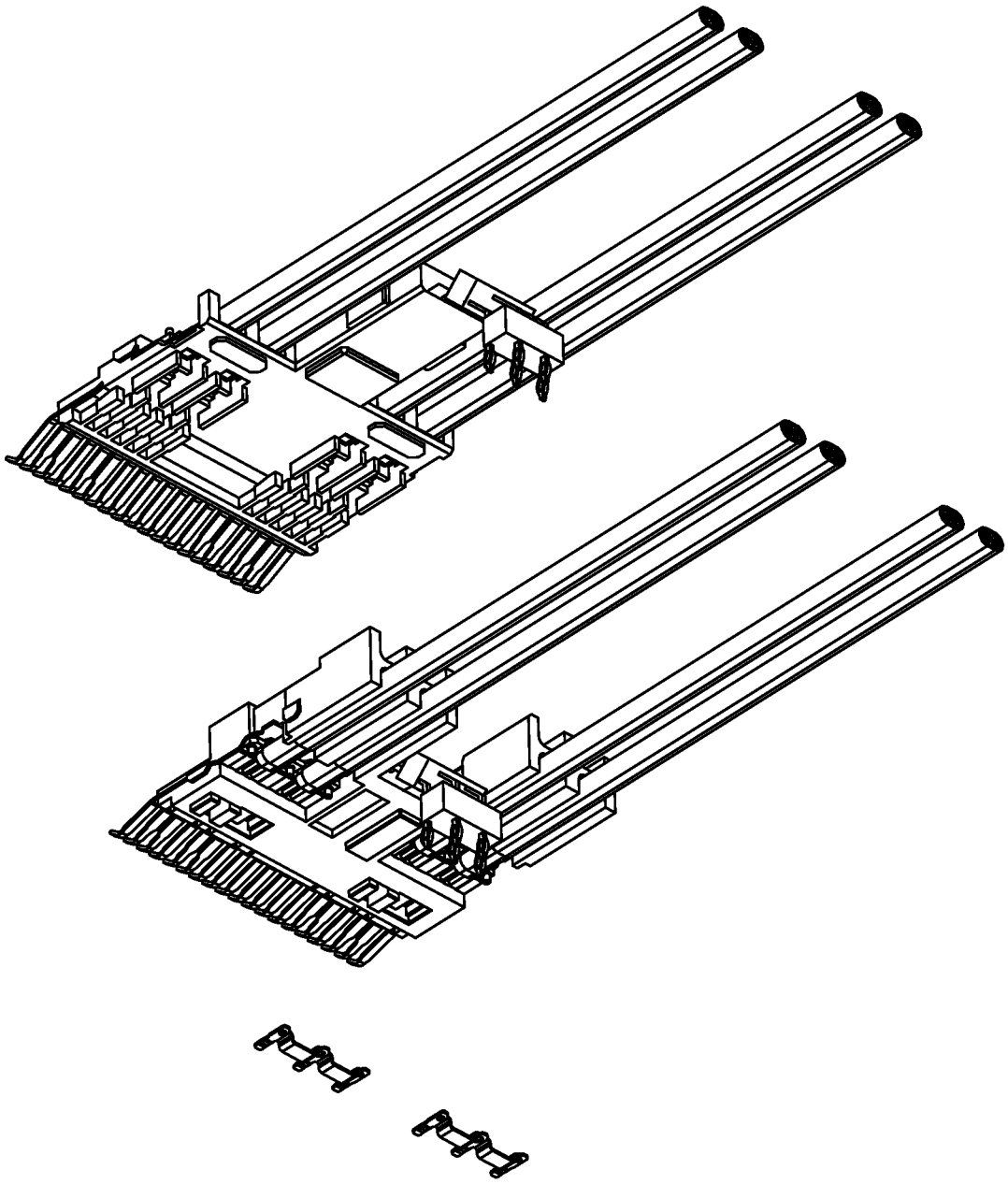
FIG. 24(B) is another exploded perspective view of the upper part of the contact module of the electrical connector assembly of FIG. 24(A)
Figure 25A:
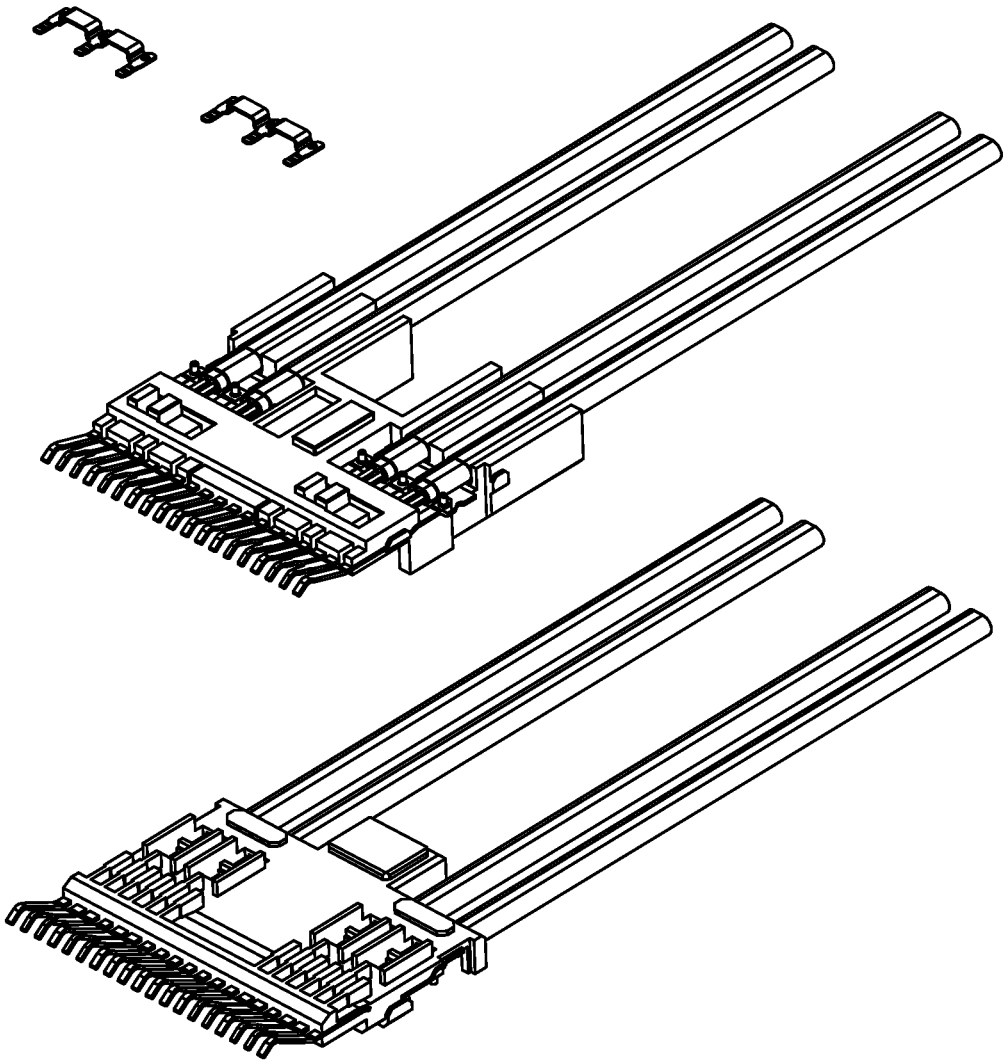
FIG. 25(A) is an exploded perspective view of the lower part of the contact module of the electrical connector assembly of FIG. 23(A)
Figure 25B:
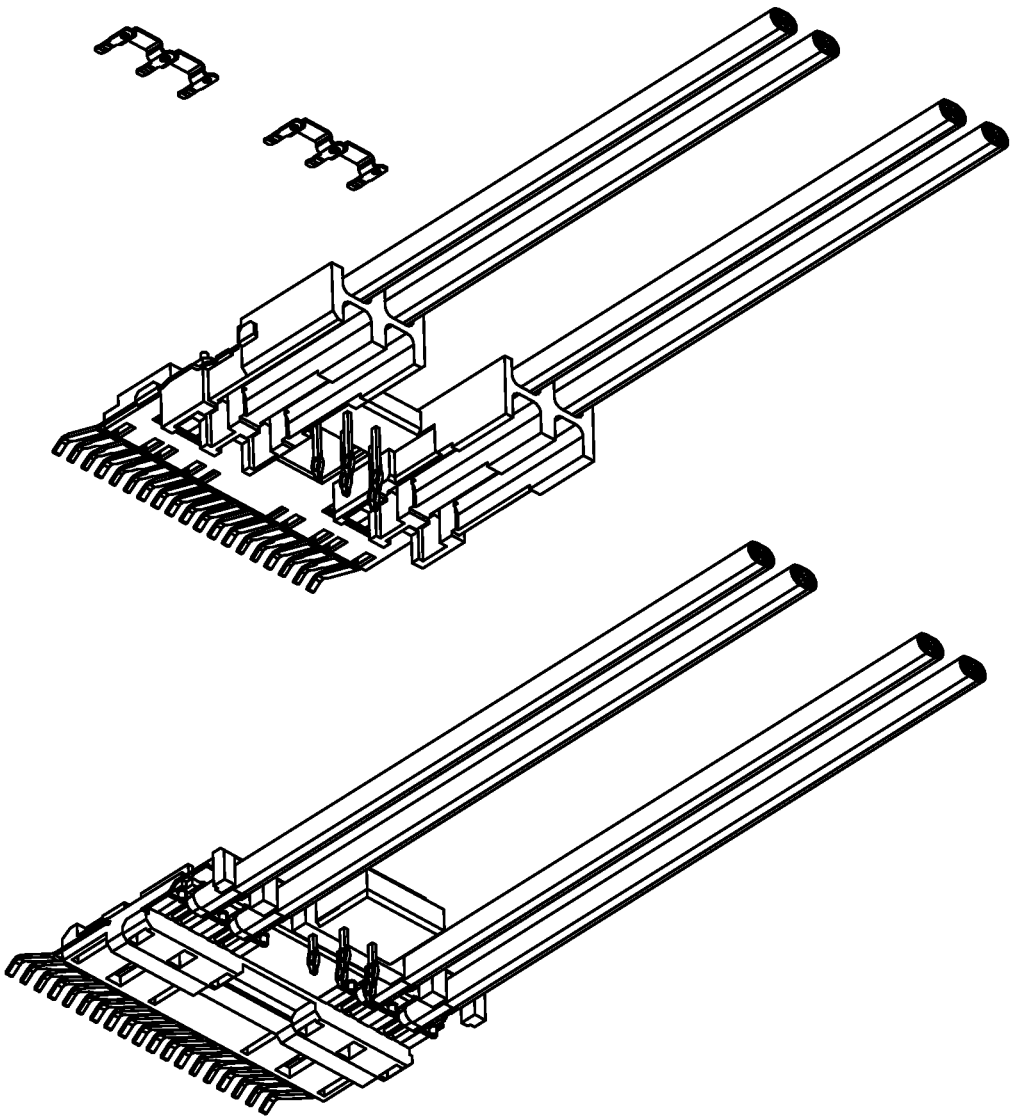
FIG. 25(B) is another exploded perspective view of the lower part of the contact module of the electrical connector assembly of FIG. 25(A)
Figure 26A:
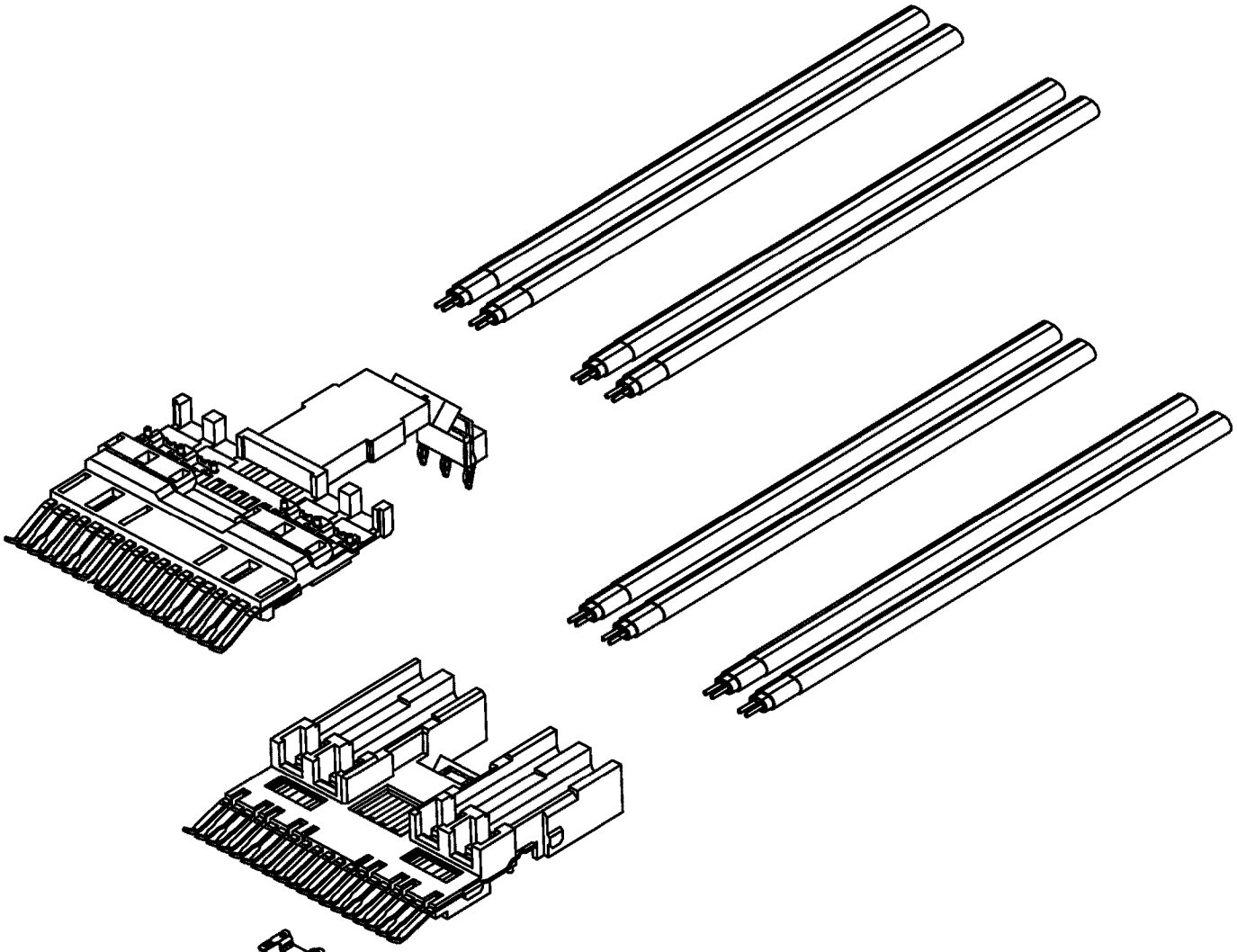
FIG. 26(A) is a further exploded perspective view of the upper part of the contact module of the electrical connector assembly of FIG. 24(A)
Figure 26B:
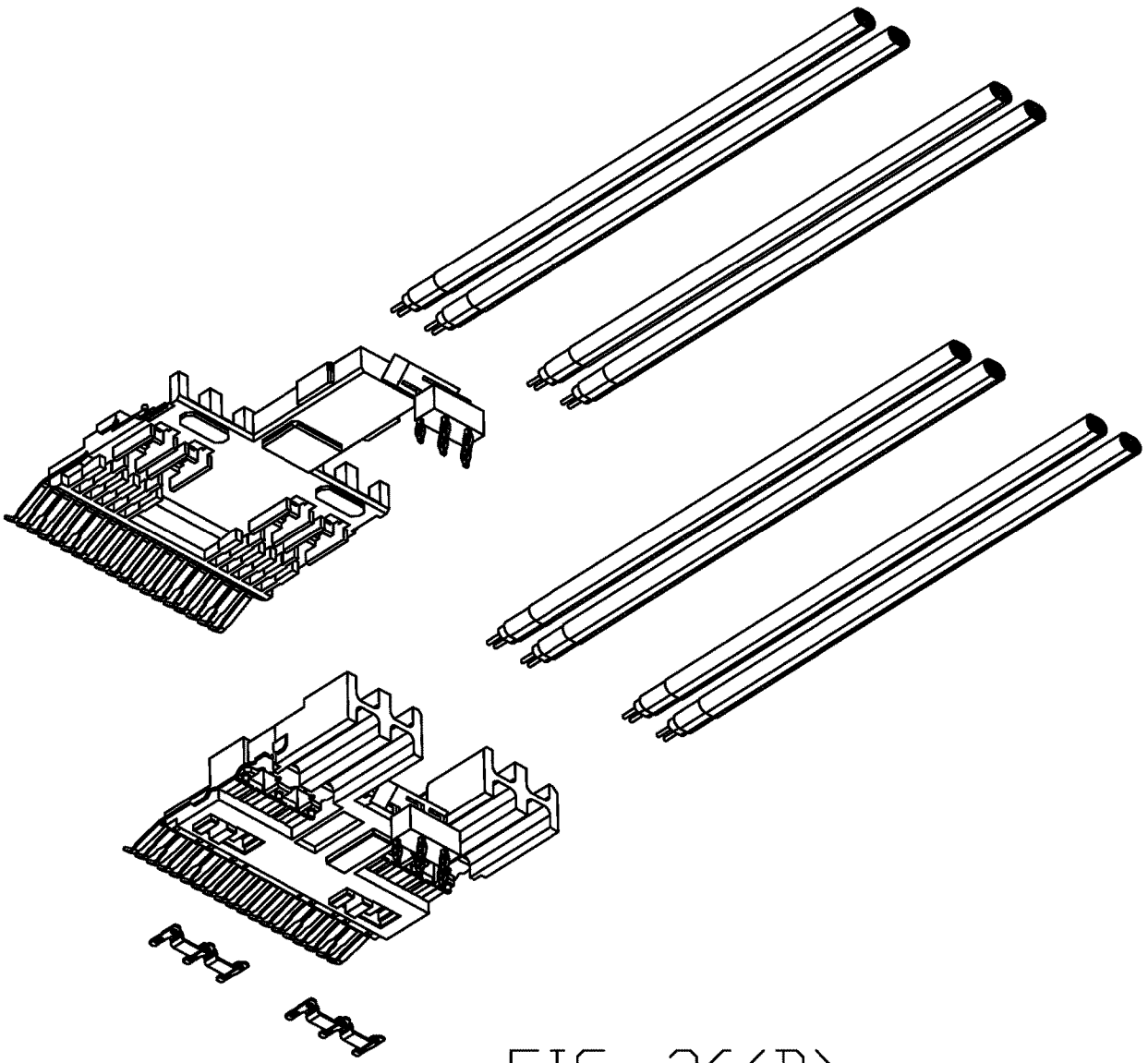
FIG. 26(B) is another exploded perspective view of the upper part of the contact module of the electrical connector assembly of FIG. 26(A)
Figure 27A:
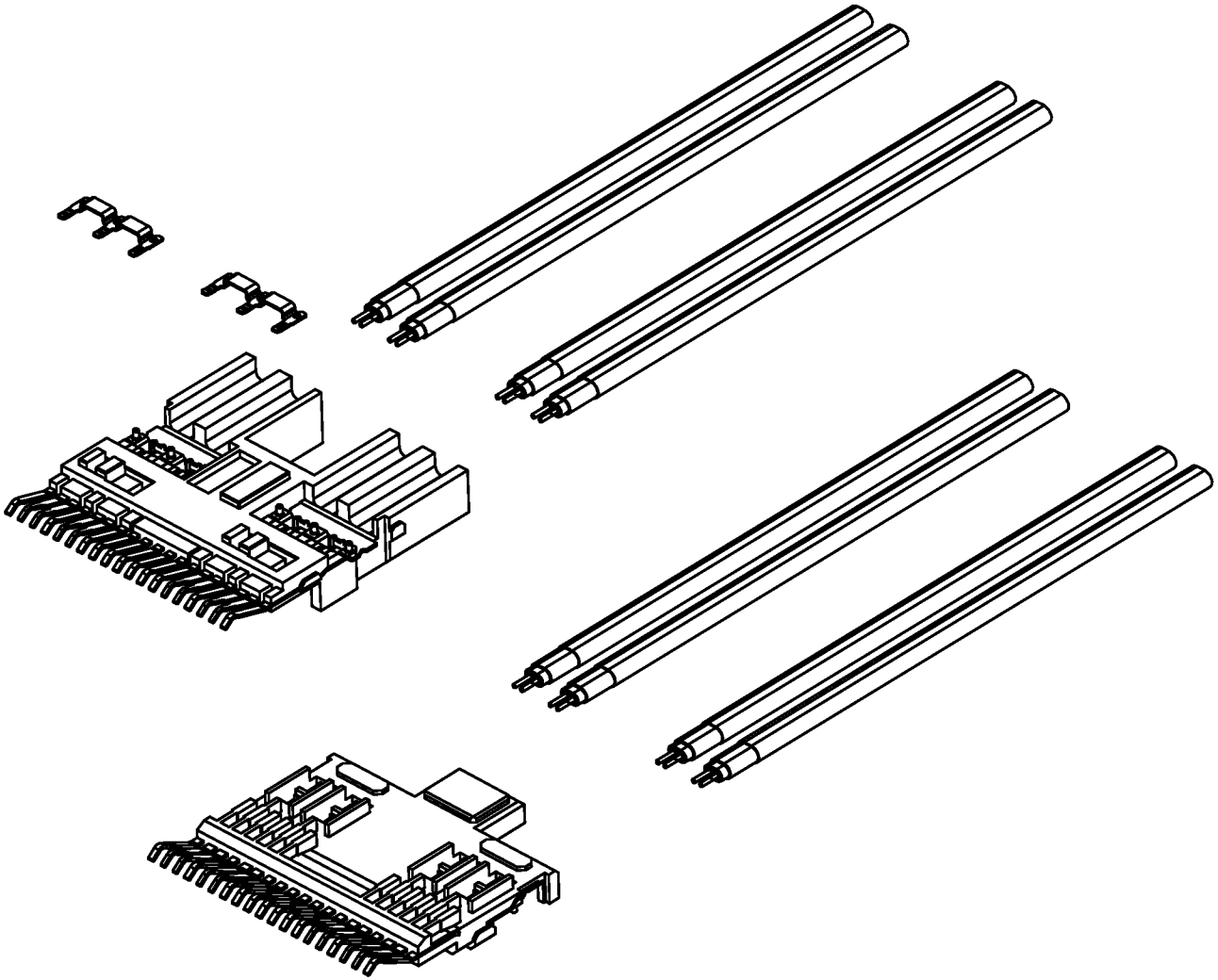
FIG. 27(A) is a further exploded perspective view of the lower part of the contact module of the electrical connector assemble of FIG. 25(A)
Figure 27B:
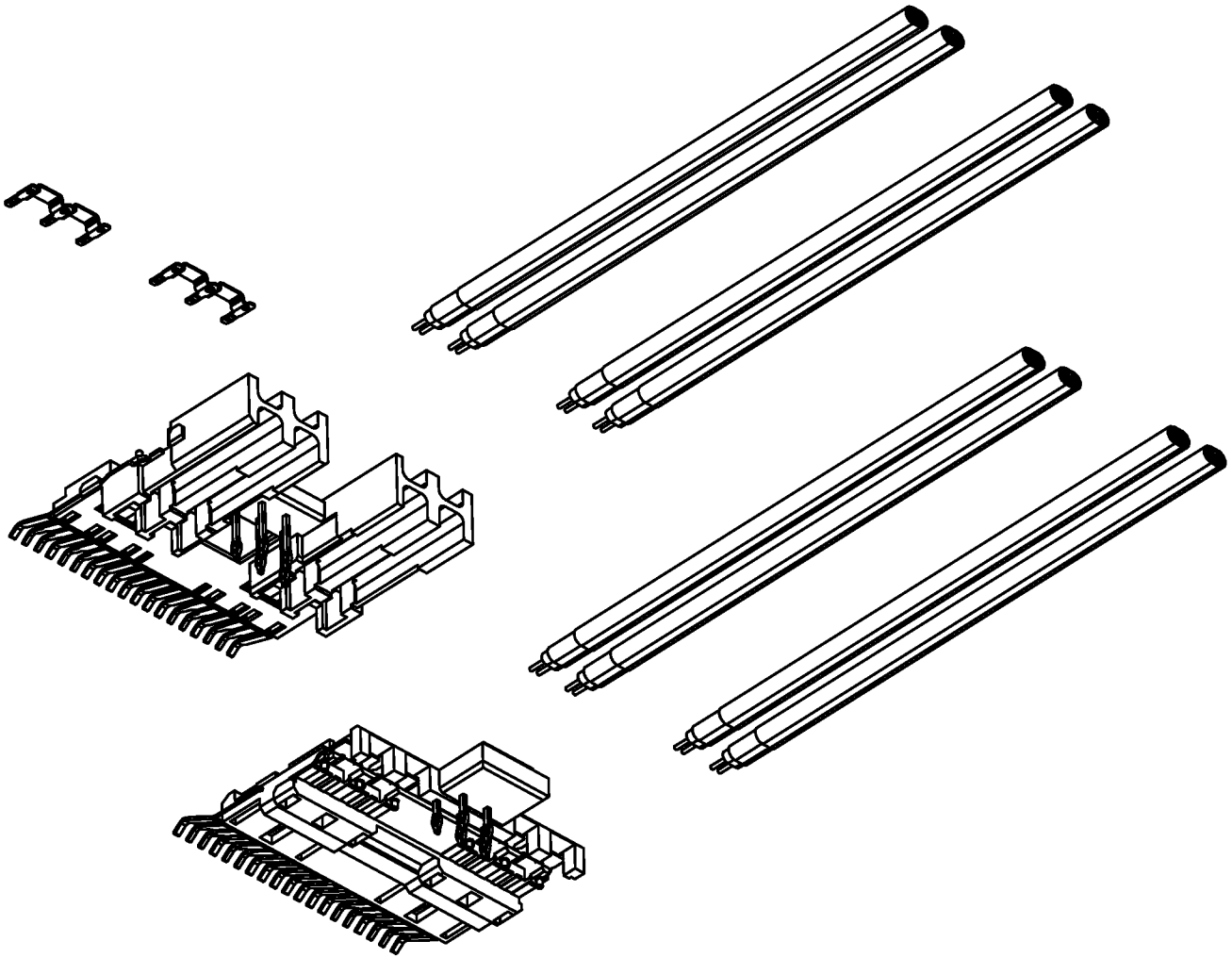
FIG. 27(B) is another exploded perspective view of the lower part of the contact module of the electrical connector assemble of FIG. 27(A)
Figure 28:
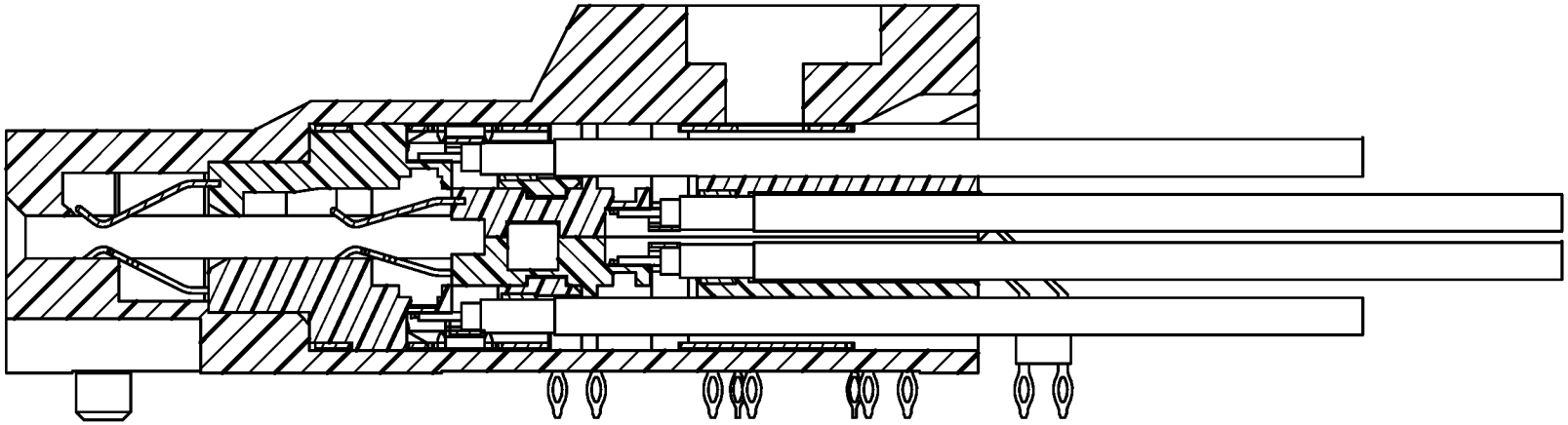
FIG. 28 is a cross-sectional view of the electrical connector assembly mounted upon the printed circuit board of FIG. 17(A) along a longitudinal direction.
Figure 29:
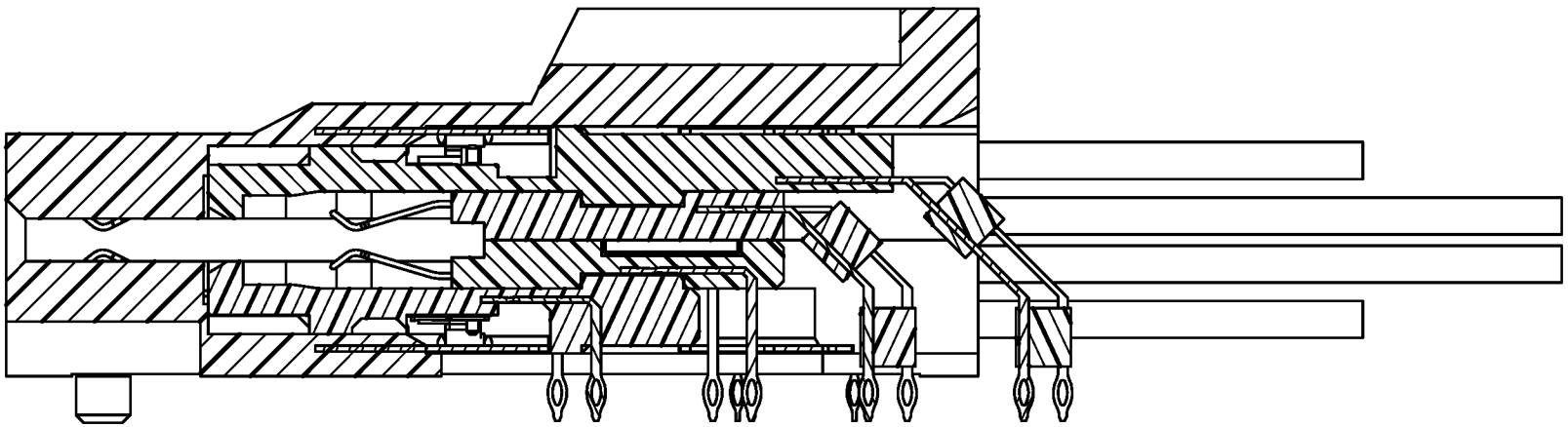
FIG. 29 is another cross-sectional view of the electrical connector assembly mounted upon the printed circuit board of FIG. 17(A) along the longitudinal direction.
Figure 30:
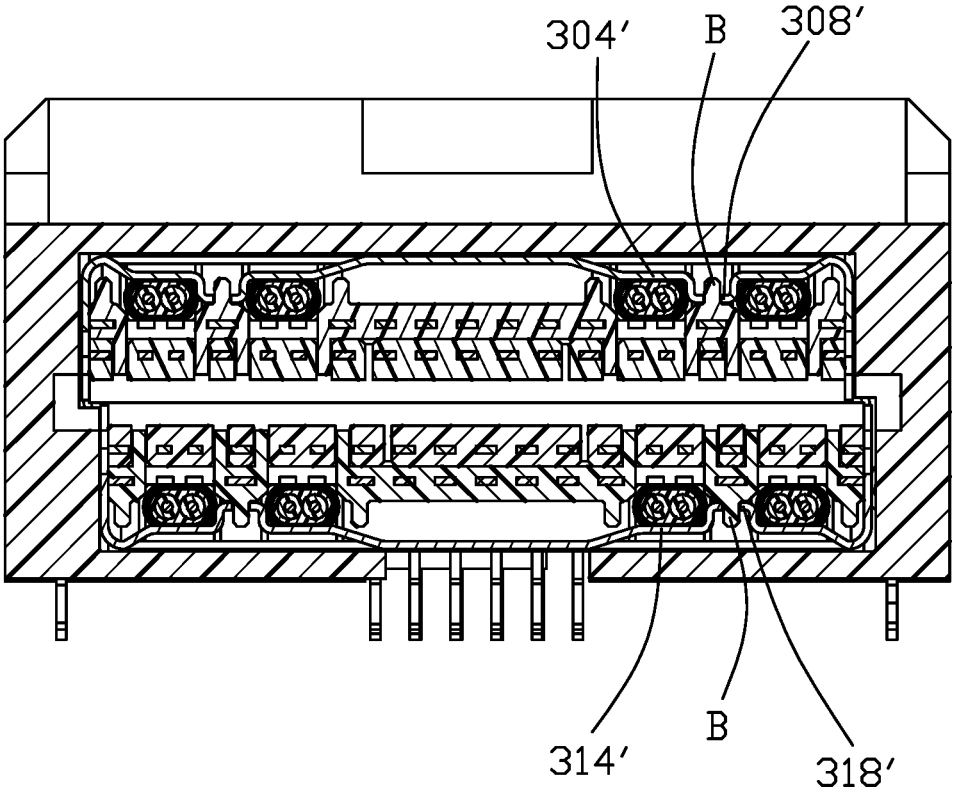
FIG. 30 is a cross-sectional view of the electrical connector assembly mounted upon the printed circuit board of FIG. 17(A) along a transverse direction.

FIGS. 17-30 disclose another embodiment of the invention wherein all structures are similar to those in the first embodiment except that the grounding brackets 223 of the front/outer upper unit 220 of the first embodiment are removed. Instead, in the shields, 300', 310', the spring tang 304 of the first embodiment is changed to the deflectable bridge 304', 314' which forms a hole 308, 318' to receive the corresponding pole B so as to have the bridge 304', 314' directly contact/soldered the braiding layer of the wire rather than through the grounding bracket used in the first embodiment.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector assembly for mounting to a printed circuit board, comprising;

an insulative housing forming a front mating slot and a rear receiving space;

a contact module received within the receiving space and including:

an upper part and a lower part stacked with each other in a vertical direction;

the upper part including a front/outer upper unit and a rear/inner upper unit stacked with each other in the vertical direction;

the lower part including a front/outer lower unit and a rear/inner lower unit stacked with each other in the vertical direction;

each of said front/outer upper unit, said rear/inner upper unit, said front/outer lower unit, and said rear/inner lower unit including an insulative body and a plurality of contacts integrally formed within the insulative body via an insert-molding process; wherein each of said front/outer upper unit, said rear/inner upper unit, said front/outer lower unit, and said rear/inner lower unit defines a middle side-band contact zone and a pair of differential-pair contact zones on two sides thereof;

the contacts in the middle side-band contact zone are directly mounted upon the printed circuit board while the contacts in the differential-pair contact zone are mechanically and electrically connected, respectively, to corresponding wires which extend rearwardly, and the insulative body of the rear/inner upper unit forms a plurality of upper slots on an upper side to receive the corresponding wires which are linked to the contacts of the front/outer upper unit, and a plurality of lower slots on a lower side to receive the corresponding wires which are linked to the contacts of the rear/inner upper unit.

2. The electrical connector assembly as claimed in claim 1, wherein the insulative body of the front/outer upper unit forms a plurality of grooves to receive front deflectable contacting sections of the contacts of the rear/inner upper unit, respectively.

3. The electrical connector assembly as claimed in claim 2, wherein the housing forms a plurality of passageways beside the mating slot to receive front deflectable contacting sections of the contacts of the front/outer upper unit.

4. The electrical connector assembly as claimed in claim 1, wherein the contact module further includes a pair of metallic shields respectively assembled upon the upper part and the lower part, and the shields include engagement tabs to be engaged within corresponding engagement holes in the housing to retain the contact module to the housing.

5. The electrical connector assembly as claimed in claim 4, wherein the front/outer upper unit further includes a metallic bracket to mechanically and electrically connect to a braiding layer of the corresponding wire, and one of said shields forms a corresponding spring tang mechanically and electrically contact the metallic bracket for common ground.

6. The electrical connector assembly as claimed in claim 5, wherein the contacts in the differential-pair contact zone include a plurality of grounding contacts unified together with a transverse bar which cooperates with the corresponding grounding bracket to sandwich the corresponding braiding layer therebetween in the vertical direction.

7. The electrical connector assembly as claimed in claim 4, wherein one of said shields forms a bridge mechanically and electrically connect to a braiding layer of the corresponding wire.

8. The electrical connector assembly as claimed in claim 7, wherein the contacts in the differential-pair contact zone include a plurality of grounding contacts unified together with a transverse bar which cooperates with the corresponding bridge to sandwich the corresponding braiding layer therebetween in the vertical direction.

9. The electrical connector assembly as claimed in claim 4, wherein the housing is further equipped with a pair of metallic mounting legs, and each of said mounting legs includes a spring finger mechanically and electrically connected to one of said metallic shields.

10. The electrical connector assembly as claimed in claim 1, wherein the upper part and the lower part are essentially arranged in a mirror image manner in vertical direction, except that all the contacts in the middle side-band contact zone of both the upper part and the lower part extend downwardly to the printed circuit board.

11. The electrical connector assembly as claimed in claim 10, wherein front deflectable contacting sections of the contacts of the upper part and those of the lower part are respectively located by two opposite sides of the mating slot in a mirror image manner.

12. The electrical connector assembly as claim 1, wherein in the upper part, an underside of the insulative body of the front/outer upper unit and an upper side of the insulative body of the rear/inner upper unit form coupling structures for alignment and engagement consideration therebetween.

13. The electrical connector assembly as claimed in claim 12, wherein an underside of the insulative body of the rear/inner upper unit and an upper side of the insulative body of the rear/inner lower unit form coupling structures for alignment and engagement consideration therebetween.

14. The electrical connector assembly as claimed in claim 1, wherein in the middle side-band contact zone, the insulative body of the front/outer upper unit includes a rearward extension received within a middle space which is formed in the insulative body of the rear/inner upper unit.

15. The electrical connector assembly as claimed in claim 14, wherein the rearward extension forms a coupling structure to be aligned and engaged with a corresponding coupling structure formed in the insulative body of the rear/inner upper unit beside the middle space.

16. The electrical connector assembly as claimed in claim 14, wherein the upper part and the lower part are essentially arranged in a mirror image manner in vertical direction, except that all the contacts in the middle side-band contact zone of both the upper part and the lower part extend downwardly to the printed circuit board.

17. An electrical connector assembly for mounting to a printed circuit board, comprising:

an insulative housing forming a front mating slot and a rear receiving space;

a contact module received within the receiving space and including:

an upper part and a lower part stacked with each other in a vertical direction;

each of said upper part and said lower part comprising an insulative body and a plurality of contacts integrally formed within the insulative body via an insert-molding process; wherein each of said upper part and said lower part defines a middle side-band contact zone and a pair of differential-pair contact zones on two sides thereof;

the contacts in the middle side-band contact zone are directly mounted upon the printed circuit board while the contacts in the differential-pair contact zone are mechanically and electrically connected, respectively, to corresponding wires which extend rearwardly; and the contact module further comprises a pair of metallic shields respectively assembled upon the upper part and the lower part, and the shields include engagement tabs to be engaged within corresponding engagement holes in the housing to retain the contact module to the housing.

18. The electrical connector assembly as claimed in claim 17, wherein the housing is further equipped with a pair of metallic mounting legs, and each of said mounting legs includes a spring finger mechanically and electrically connected to one of said metallic shields.

19. An electrical connector assembly for mounting to a printed circuit board, comprising;

an insulative housing forming a front mating slot and a rear receiving space;

a contact module received within the receiving space and including:

an upper part and a lower part stacked with each other in a vertical direction;

the upper part including a front/outer upper unit and a rear/inner upper unit stacked with each other in the vertical direction;

the lower part including a front/outer lower unit and a rear/inner lower unit stacked with each other in the vertical direction;

each of said front/outer upper unit, said rear/inner upper unit, said front/outer lower unit, and said rear/inner lower unit including an insulative body and a plurality of contacts integrally formed within the insulative body via an insert-molding process; wherein each of said front/outer upper unit, said rear/inner upper unit, said front/outer lower unit, and said rear/inner lower unit defines a middle side-band contact zone and a pair of differential-pair contact zones on two sides thereof;

the contacts in the middle side-band contact zone are directly mounted upon the printed circuit board while the contacts in the differential-pair contact zone are mechanically and electrically connected, respectively, to corresponding wires which extend rearwardly; and the contact module further includes a pair of metallic shields respectively assembled upon the upper part and the lower part, and the shields include engagement tabs to be engaged within corresponding engagement holes in the housing to retain the contact module to the housing.

20. The electrical connector assembly as claimed in claim 19, wherein the front/outer upper unit further includes a metallic bracket to mechanically and electrically connect to a braiding layer of the corresponding wire, and one of said shields forms a corresponding spring tang mechanically and electrically contact the metallic bracket for common ground.

* * * * *